US007635285B2

(12) United States Patent
Carroll et al.

(10) Patent No.: US 7,635,285 B2
(45) Date of Patent: Dec. 22, 2009

(54) NETWORK CONNECTOR AND CONNECTION SYSTEM

(75) Inventors: James A. Carroll, 8210 W. 109th St., Bloomington, MN (US) 55438; Thomas R. Finke, Wayzata, MN (US)

(73) Assignee: James A. Carroll, Bloomington, MN (US)

( * ) Notice: Subject to any disclaimer, the term of this patent is extended or adjusted under 35 U.S.C. 154(b) by 0 days.

(21) Appl. No.: 12/011,476

(22) Filed: Jan. 25, 2008

(65) Prior Publication Data

US 2008/0188138 A1 Aug. 7, 2008

Related U.S. Application Data

(63) Continuation of application No. 11/639,729, filed on Dec. 15, 2006, now Pat. No. 7,335,066.

(60) Provisional application No. 60/751,199, filed on Dec. 16, 2005, provisional application No. 60/831,649, filed on Jul. 18, 2006, provisional application No. 60/837,494, filed on Aug. 14, 2006.

(51) Int. Cl.
*H01R 24/00* (2006.01)

(52) U.S. Cl. ..... 439/676; 439/344; 439/941

(58) Field of Classification Search ..... 439/676, 439/344, 623, 941; 174/32, 34, 27, 138 E, 174/146

See application file for complete search history.

(56) References Cited

U.S. PATENT DOCUMENTS 4,101,114 A 7/1978 Martin et al.
4,171,123 A 10/1979 Woelkers
4,684,161 A 8/1987 Egner et al.
4,731,663 A 3/1988 Kovalchick et al.
5,009,612 A 4/1991 Rishworth et al.
5,308,260 A * 5/1994 Johnston et al. ..... 439/344
5,328,390 A * 7/1994 Johnston et al. ..... 439/638

(Continued)

FOREIGN PATENT DOCUMENTS

DE 20117317 U1 12/2001

OTHER PUBLICATIONS

Zone Cabling Paper; Blending An Old Idea With New Technology; John C. Leavitt, Nilgun A. Leavitt, Altug Consulting Engineers; Jul. 9, 2000; 15 pages.

(Continued)

*Primary Examiner*—Edwin A. Leon
*Assistant Examiner*—Vanessa Girardi
(74) *Attorney, Agent, or Firm*—Patterson, Thuente, Skaar & Christensen, P.A.

(57) ABSTRACT

A network connection system for connecting computer and telephone network components, including a twisted pair cable termination connector for use with twisted pair cable, the twisted pairs being arranged within an outer cable jacket such that each twisted pair substantially occupies a cross sectional quadrant of the cable. The connector includes a pair separator having four passages arranged to substantially keep the four twisted pairs in a quadrant relationship relative to one another and in which the twisted relationship of each twisted pair is maintained substantially until the conductors are electrically terminated to their respective conductive contact member; and a mating component adapted to couple with the twisted pair cable termination connector.

18 Claims, 30 Drawing Sheets

U.S. PATENT DOCUMENTS 5,403,200 A 4/1995 Chen
5,409,397 A 4/1995 Karman
5,431,370 A 7/1995 Verkuylen et al.
5,480,203 A 1/1996 Favalora et al.
5,498,172 A 3/1996 Noda
5,505,432 A 4/1996 Noonan
5,538,438 A 7/1996 Orlando
5,601,447 A 2/1997 Reed et al.
5,830,005 A 11/1998 Watanabe
5,911,594 A 6/1999 Baker, III et al.
5,938,181 A 8/1999 Holden
5,951,330 A * 9/1999 Reichard et al. ..... 439/676
5,961,354 A 10/1999 Hashim
5,969,295 A 10/1999 Boucino et al.
5,996,224 A 12/1999 Sullivan
6,019,641 A 2/2000 Kan
6,080,007 A 6/2000 Dupuis et al.
6,193,542 B1 2/2001 Marowsky et al.
6,276,943 B1 8/2001 Boutros et al.
6,280,232 B1 8/2001 Beecher et al.
6,305,950 B1 10/2001 Doorhy
6,325,660 B1 12/2001 Diaz et al.
6,328,610 B1 12/2001 Chang
6,332,802 B2 12/2001 Hirokawa
6,370,769 B1 4/2002 Lilienthal, II
6,371,793 B1 * 4/2002 Doorhy et al. ..... 439/404
6,375,491 B1 4/2002 Durand et al.
6,396,993 B1 5/2002 Giebel et al.
6,398,591 B1 6/2002 Hess et al.
6,402,545 B1 6/2002 Huang
6,402,559 B1 6/2002 Marowsky et al.
6,406,325 B1 6/2002 Chen
6,409,535 B1 6/2002 Marowsky et al.
6,409,539 B1 6/2002 Shi et al.
6,409,548 B1 6/2002 Guttierez
6,409,549 B1 6/2002 Yeh
6,431,918 B1 8/2002 Given et al.
6,508,677 B1 1/2003 Wang
6,517,386 B2 2/2003 Sakakura et al.
6,524,128 B2 2/2003 Marowsky et al.
6,558,204 B1 5/2003 Weatherley
6,729,901 B2 5/2004 Aekins
6,902,406 B1 * 6/2005 Kraus ..... 439/11
6,953,362 B2 10/2005 Mossner et al.
7,017,267 B2 3/2006 Carroll
7,025,636 B2 * 4/2006 Allen ..... 439/638
7,163,416 B2 1/2007 Carroll
7,223,112 B2 5/2007 AbuGhazaleh et al.
7,229,309 B2 * 6/2007 Carroll et al. ..... 439/418
7,335,066 B2 2/2008 Carroll
2001/0027062 A1 * 10/2001 Beneke et al. ..... 439/638
2003/0171024 A1 * 9/2003 Mossner et al. ..... 439/404
2005/0037672 A1 2/2005 Caveney et al.
2005/0164560 A1 7/2005 Carroll
2005/0181676 A1 * 8/2005 Caveney et al. ..... 439/676
2006/0046575 A1 * 3/2006 Allen ..... 439/638
2006/0160407 A1 7/2006 Carroll et al.
2008/0007372 A1 1/2008 Carroll

OTHER PUBLICATIONS

American Access Technologies, Inc.™ Brochure; Solutions to Open Office Architectures; 12 pages; Undated.
Hitachi Cable Manchester, Inc.; Balanced Twisted-Pair Copper Cable; Brochure pp. 1-6; © Oct. 2001.

* cited by examiner 134
135
114
120
128
122
124
129
132
112
138
136
135

138
114
135
136
126
130
122
136

128
136
130
130
124
114
136
130

142
140
140

140
140

144
140

134
135
144
148
146
150
144
140

262
110
102
SCALE 4.000

264
262
265
110
102
SCALE 4.000

102
110

102
222
110

222
102
110

142
140

266
142

266
140
140

266
140
142
140

269
140
278
142
269
269
104
102

304
298
304
298
302
300
302
300

298
306
298
304
306

300
302
310
306
298
300
302
300
304
304

110
102

310
308
306
278

SCALE 8.000
312
110
102

110
201

314
312
110
201

314

318
320
322
324
326
328
330
332
334

PAIR 1
PAIR 2
PAIR 3
PAIR 4

PAIR 1
PAIR 2
PAIR 3
PAIR 4
116
340
388
368
370
412
374
911

390
111
102
104

39°
111
338

39°
111
338

39°
111
338
278
78

39°
111
338

39°
111
338
338

278
278

288
282
278
280
284
286

392
408
400
394
404
406
410
398
396
402
110

314
100
338
102

314
110
102

404
410
412

116
106
42

102
338
116

424
122
114
178
424
184
154
180
422
426
338
102
190
324
106
102

106
181
102

428
196
194
188
430
428
188
190

108
424
428
424
428
424

101
108
101

102
108
102

102
434
400
404
432
314
201
110

NETWORK CONNECTOR AND CONNECTION SYSTEM

CLAIM TO PRIORITY

This application is a continuation of application Ser. No. 11/639,729, filed Dec. 15, 2006 now U.S. Pat. No. 7,335,066, which claims the benefit of U.S. Provisional Application No. 60/751,199, filed Dec. 16, 2005, U.S. Provisional Application No. 60/831,649, filed Jul. 18, 2006, and U.S. Provisional Application No. 60/837,494, filed Aug. 14, 2006 each of which is hereby incorporated herein by reference.

FIELD OF THE INVENTION

The invention generally relates to connectors for wiring computer and telephone networks. More particularly, the invention relates to connectors for termination of twisted pair cables to network subcomponents.

BACKGROUND OF THE INVENTION

Twisted pair cables are commonly used for the wiring of computer and telephone networks. Twisted pair wire orientation is governed by EIA/TIA Standard 568B and industry connection methods Conventional twisted pair cable includes four twisted pair conductors inside an outer insulation jacket. In some cables a plastic cross shaped extrusion resides inside the cable jacket along with the wires to separate the four pairs from each other and maintain each pair within its own quadrant within the cable jacket.

The four twisted pairs are color coded as a blue pair, a green pair, an orange pair, and a brown pair. Each pair includes two conductors: a first conductor covered by solid color insulation colored to match that pair designation and a second conductor covered by white insulation with colored stripes that are the same color as the solid colored insulation twisted together. For example, the blue pair includes one wire solid blue in color and a second wire white with blue stripes. The same is true for the green, orange, and brown pairs. In the 568B standard, the color coding standardizes the position each conductor occupies when assembled into an RJ45 modular connector or modular jack.

There are 8 positions in a modular connector, one for each conductor. A prior art RJ45 plug includes a front where it mates with a jack and a rear where the twisted pair cable enters the plug. The RJ45 plug includes a locking tab to releasably secure it to the jack. Viewing the front of the RJ45 plug, with the locking tab at the top, eight conductor positions are designated one through eight from left to right. Under the standard, the blue pair typically is designated Pair #1 and occupies positions 4 and 5 with the solid blue conductor in position 4 and the white/blue conductor in position 5. The Orange pair is designated Pair #2 and occupies positions 1 and 2 with the white/orange conductor in position 1 and the Orange conductor in position 2. The green pair is designated Pair #3 and is also known as the split pair in the RJ45 assembly because it occupies positions 3 and 6 with the solid green conductor in position 6 and the white/green color conductor occupying position 3. The brown pair is designated Pair #4 and occupies positions 7 and 8. The white/brown conductor is located in position 7 and the solid brown conductor in position 8. The importance of these standardized positions will become apparent in the description of the sub components and assembly of the new connector of the present invention.

The most dominant interface for connecting 4 pair twisted pair cable in the market at the time of this application is the RJ45 connector interface as described by the FCC in 47 CFR 68 Subpart F. The FCC standard describes dimensional tolerances for the plug, port and features to assure operable compatibility between plugs and jacks made by various manufacturers. Other RJ style connector interfaces also exist.

Typically an industry standard modular jack has one port for mating with an RJ45 plug, that meets the requirements of FCC under 47 CFR 68 Subpart F and a second port that is adapted to attach twisted pair cable conductors to the jack. Generally, jacks are terminated to twisted pair cable in the field by stripping back the outer insulating jacket, exposing the conductor pairs, and terminating the individual conductors of these pairs to terminals on the jack. Patch cords in predetermined lengths, with RJ45 plugs assembled to each end, are available to connect hardware such as computer work stations and printers to the modular jacks and thus to the network.

Typical RJ modular plug designs are used with cable made up of 4 twisted pairs and a plug assembly that attaches to the cable, making connection with the 4 pairs. The twisted pairs are identified as Pair 1, Pair 2, Pair 3, and Pair 4. There exists a wiring standard known as TIA/EIA 568-B T568B that assigns the blue/blue-white pair as pair 1, the orange/orange-white pair as Pair 2, the green/green-white pair as Pair 3, and the brown/brown-white pair as Pair 4.

At the connection interface end of the plug assembly there are a series of 8 slots that house blade contacts that make up the physical and electrical interface between the plug assembly and a jack with which the plug mates. This interface configuration is well known by those skilled in the technology and fully defined by an industry standard. To assure proper continuity of signal pairs through a structured cabling system, it is required that the cable pairs assume specified positions within the plug assembly. Slots in the plug are identified as slot or "Pin 1" sequentially to slot or "Pin 8" across the series of slots. The orange/orange-white (Pair 2) occupies slot positions 1 and 2, the green/green-white pair (Pair 3), also known as the split pair, occupies slot positions 3 and 6, the blue/blue-white (Pair 1) occupies slot positions 4 and 5, and the brown/brown-white (Pair 4) occupies the 7 and 8 slot positions.

The orange-white, green-white, blue-white, and brown-white are the striped conductors of the pair while the partnering conductor of the pair is a solid color (orange, green, blue, and brown). The striped colored conductors occupy the odd sequence of slots (1, 3, 5, and 7). The solid colored conductors occupy the even series of slots (2, 4, 6, and 8).

This nomenclature and practice is consistent within structured cable systems in the industry to assure signal integrity and continuity as well as interoperability between vendor products. There also exists a wiring standard know as TIA/EIA 568-B T568A that defines a different wire placement. The design described herein can apply to either standard T568A or T568B however for the purpose of description, only the T568B will be referred too.

In many cases, the modular connector is installed by craft personnel in the field. Problems are associated with installing jacks and plugs in the field related to inconsistency of method that occur from one installer to the next. These result is failures in data transmission and the expenditure of large amounts of time and effort to troubleshoot and repair inadequate field made connections.

Thus the network wiring industry would benefit from a network wiring termination system that that would allow for pre-termination of conductors, testing of the network wiring components prior to release to field personnel and ease of pulling network wiring through conduit and past obstacles that are commonly encountered in the installation of network cabling.

SUMMARY OF THE INVENTION

The connector system of the present invention solves many of the above discussed problems and generally includes a connector, connector cover, connector to RJ jack, a connector to connector jack and a RJ adapter. The connector system of the present invention is utilized to terminated twisted pair cables that are commonly routed within walls, ceilings and floors to be coupled the components of telephone and computer networks. The connector system of the present invention provides improved ease of coupling network components while at the same time providing improved signal performance for the network components by controlling cross talk that tends to occur between conductors of twisted pair cables when the twisted pairs are untwisted for coupling to the jacks that are used in currently available network systems.

The connector of the present invention is structured to maintain the twist of twisted pair cable as much as possible through the body of the connector until it reaches contacts within the connector that connect to other network components, such as the RJ adapter, connector to connector jack or connector to RJ jack. The connector of the present invention includes a pair separator body that guides the conductors of the twisted pairs to locations at which they are terminated by contacts that allow coupling to other components of the connector system. The pair separator generally maintains the quadrant arrangement of the twisted pairs similar to the quadrant arrangement of twisted pairs that occurs in the twisted pair cable.

For the purposes of this application, the term "quadrant" is considered to include the classical geometrical meaning of the term as well as meaning an approximate division of an area or structure into four areas or regions that meet at a central location. The quadrants need not be precisely the same size or shape nor do lines dividing the quadrants need to meet at right angles.

The connector cover of the present invention can be used to cover and enclose at least part of the connector once assembled to protect the connector from dirt and damage while it is in shipping and being routed through conduits, walls, ceilings, floors or other structures.

The connector to RJ jack of the present invention is intended for mounting in a wall or central location to which a patch cord is plugged in. The exterior connector of the connector to RJ jack is an industry standard RJ style connector such as RJ45 female coupler for receiving a RJ45 male patch cord. The interior connector side of the connector to RJ jack is intended for much longer term coupling. The connector side is intended for to provide the option for connection and disconnection several times during its life, but it is not intended for coupling and uncoupling as often as the RJ45 side of the connector to RJ jack.

The connector to connector jack in accordance with the present invention, allows for the coupling of preterminated twisted pair of cables if it is necessary to extend the length of twisted pair of cables by connecting them end to end.

The RJ adapter of the present invention can be connected to the connector of the present invention to provide an RJ style connection, such as an RJ45 connection, which then can be used as a patch cord or connected directly into the network port of a computer or telephone.

Some embodiments of the present invention utilize insulation displacement type electrical contacts which can be coupled to blade type contacts to provide a reusable but extremely reliable electrical connection between conductors.

Some embodiments of the present invention also utilize a pair guide to place and align twisted pairs within the body of the connector to maintain an appropriate relationship between the twisted pairs to minimize cross talk and interference between the twisted pairs.

Some embodiments of the present invention use stamped and formed contacts within the connector to RJ jack, connector to connector jack or RJ adapter. Other embodiments of the present invention utilize flexible or conventional printed circuits or printed circuit boards to connect contacts within the connector to RJ jack, connector to connector jack or RJ adapter and to manage crosstalk.

The design trend of high performance Ethernet cable has been to separate the position of four twisted pairs within the jacket of the cable into four separate quadrants extending along the length of the cable. This is done to control and manage cross talk between pairs. In many instances a cross or "X" shaped extruded divider extends through the interior of the cable along its full length with the twisted pair conductors thus creating a divisional barrier that defines the quadrants that each twisted pair resides within.

In some embodiments of the connector to RJ jack, the first or exterior port is a female RJ style port such as an industry standard RJ45 interface designed to accept an industry standard RJ45 modular connector defined by FCC Part 68. This port is intended to be the quick release patch port that may be connected and disconnected many times over the life of the jack. It is typically the port that patch cords are plugged into.

The second or interior port of the jack is intended to be a more permanent connection port that may be connected and disconnected occasionally throughout the life of the jack but with nowhere near the frequency of the opposing RJ45 port. This second port provides a very reliable and secure electrical connection because this port is more often than not located in restricted access areas such as the wall behind the faceplate of an outlet box, or in the wall structures of modular furniture systems or in the rear of patch panels. For these reasons, in the prior art, a more secure connection system known as an Insulation Displacement Contact (IDC) is commonly used in this port to connect the conductors of the cable to the conductors that carry the signal through the jack.

The IDC has been shown to be a highly reliable connection type. The mechanics of an IDC connection are two fold. First, as a conductor wire of the cable is pressed into the slot of the IDC, the two opposing tines are rigid enough to sever and tear away the outer jacket insulation of the conductor wire exposing the copper conductive core. Secondly, as the wire is further pressed into the IDC slot, a high pressure squeezing force is created on the exposed copper by the opposing tines. This pressure creates an airtight physical and electrical connection between the conductor and the contact which creates a secure and reliable low resistance electrical path through the connection.

In jacks today, very little is done to manage the routing and the physical position of the cable and conductors leading up too this second port connection with the jack. Inconsistencies occur like the amount of outer cable jacket stripped back exposing the twisted pair conductors, the position and path of the twisted pairs as they exit the cable jacket and make their way to the IDC slots, the management or mismanagement (untwisting) that occurs as the conductors are positioned and terminated to the IDC contacts. These inconsistencies can create variation in functioning performance of the jack connection. It has been found that close management of the twist of the pairs of conductors in twisted pair cable is very important to reducing the performance-limiting cross talk that can occur between pairs.

The connector and connection method described here are designed to improve over and out perform other connections associated with the second port. This is accomplished by closely managing and reducing the length of conductor untwist in the connector, maintaining the quadrant division philosophy of the cable through the connector and jack to the greatest extent possible, and providing a connection system that is very repeatable from one connector and connection to the next, substantially eliminating operator installation inconsistencies.

The connector of the present invention is intended to be used primarily as a pre-terminated connector, meaning that it is assembled to a pre-specified length of twisted pair cable or twisted pair bundled cable in a controlled manufacturing environment. This should not be considered limiting. However because of the simplicity of the design it is conceived that the connector could also be installed in the field using appropriate hand crimp and trimming tools.

The connector includes the following characteristics and features.

1) In some embodiments, the size profile of the connector closely matches the diameter of the cable it is being assembled to. It has no protruding latches or catches that are common among typical connectors used in Ethernet cabling systems and the profile is intended to be smooth along the length of the connector. This allows the connector to be pre-terminated and tested in a manufacturing environment and then installed in the field by pulling the connectorized cable through structured cable guides such as conduit runs, ladder racks, plenum channels, within suspended ceilings, under floors, and within walls. The size and shape profile of the connector largely eliminates snagging or "hang ups" as the cable is pulled into position.
2) As discussed above, the size of the cross section profile of the connector is very close to that of the cable diameter. The invention is easily scalable to larger diameter cables that may have improved signal carrying performance. The designs of prior art connectors are generally not easily scalable to larger cable diameters and in most cases this is not feasible.
3) In some embodiments, the connector of the present invention provides conductor managing ports, channels or passages that maintain the twist of the twisted pair conductors to a location as close as possible to the point where they are terminated by contacts.
4) The connector of the present invention can, through addition of an RJ adapter cap, can substitute for an industry standard RJ style plug and couple to an RJ45 jack or other RJ jack.
5) In one aspect of the invention, the primary intended use of this connector is to connect to the rear port or the permanent port side of an RJ45 jack. It is thought of as the "permanent" side of the jack because this is typically the port that resides inside of a wall structure or behind a faceplate. The connector of the present invention improves reliability and repeatability of the connection at the back of the jack because it may be pre-tested in a controlled manufacturing environment, it is assembled in a controlled manufacturing environment, not in the field, and the position of the conductors and contacts has been tuned to optimized signal carrying performance and is consistent from one plug/jack connection to the next. Prior art connections are done by hand, in the field, by craft people who manually strip back and untwist wires that are then laid down onto the top of an IDC array at the back of the jack and then punched down into the IDC slots to make the termination contact. There is little control or repeatability to this process. In addition, if a jack needs to be re-terminated to the cable, the conductors are pulled out of the IDC slots and refanned out over the IDC array using a new and untwisted length of conductor. In contrast, the connector of the present invention can simply be unplugged and re-plugged as needed multiple times.
6) The invention utilizes highly reliable IDC type electrical and mechanical contact that is made between the connector contacts and the cable conductors. It is thought to be the only connector of this type using an IDC type contact for this purpose.
7) Features of the inventive connector design reduce the amount of disruption to the cable and the conductor twist when terminating it to the cable.

In some embodiments of the invention, the connector includes a pair separator. The pair separator strategically maintains, to a substantial degree, the quadrant spacing and pair positioning of twisted pair cable conductors, as found inside the cable jacket, so that they may interface with a mating contact, mating connector or a mating jack.

The lay of the individual conductors or pairs within a twisted pair Ethernet cable is important to signal carrying capacity. Typically twisted pair cables are manufactured and structured with a controlled pitch of twist and they demonstrate superior performance in comparison to connection components inserted and used to connect hardware and build out a network. The connector design mimics or matches as closely as possible the structure of the cable to achieve optimal performance.

The design trend of high performance Ethernet cable has been to separate the position of four twisted pairs within the jacket of the cable into four separate quadrants extending along the length of the cable. This is done to control and manage cross talk between pairs. In many instances a cross or "X" shaped extruded divider extends through the interior of the cable along its full length with the twisted pair conductors thus creating a divisional barrier that defines the quadrants that each twisted pair resides within.

BRIEF DESCRIPTION OF THE DRAWINGS

FIG. 99 is an exploded perspective view of a RJ adapter including stamped and formed conductors in accordance with the present invention.

DETAILED DESCRIPTION

Figure 1A:
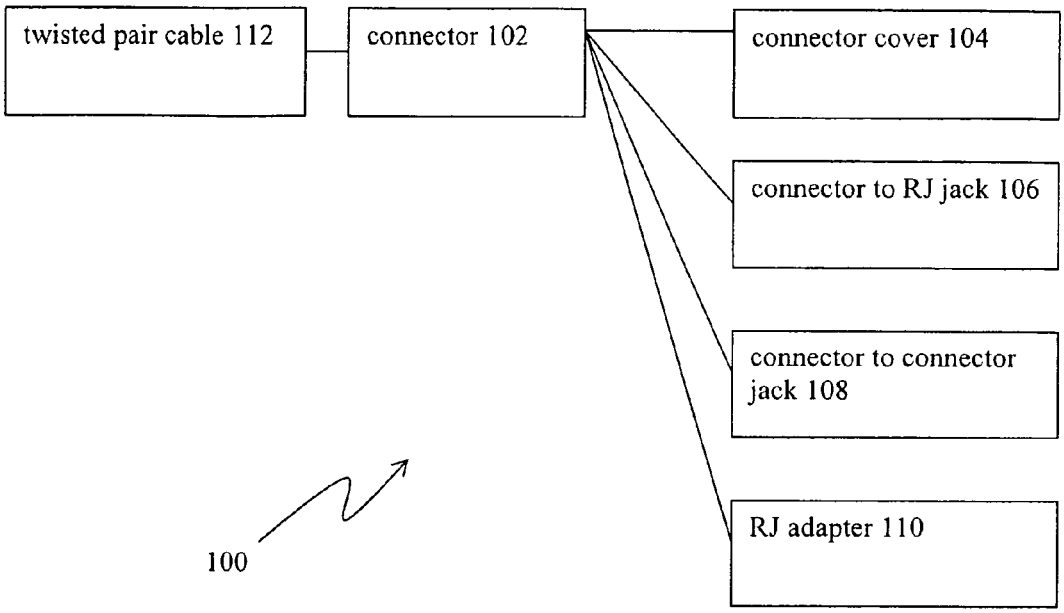
FIG. 1*a* is a block diagram of a connector system in accordance with the present invention.
Figures 1B, 2, 3:
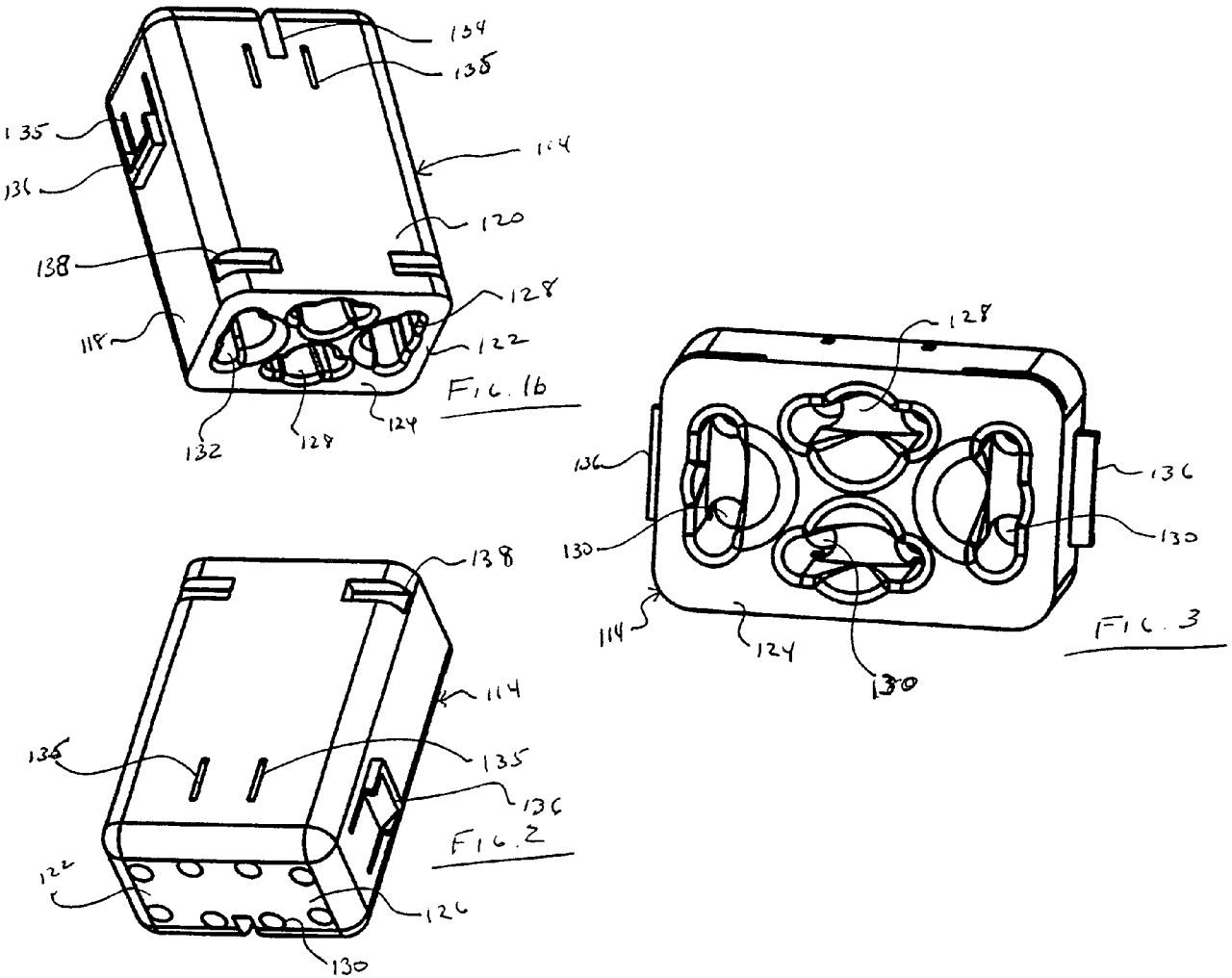
FIG. 1*b* is a perspective view of a pair separator in accordance with the present invention.
FIG. 2 is another perspective view of the pair separator in accordance with the present invention.
FIG. 3 is another perspective view of the pair separator in accordance with the present invention.

The network connector system 100 of the present invention, as depicted in FIG. 1*a*, generally includes connector 102, connector cover 104, connector to RJ jack 106, connector to connector jack 108 and RJ adapter.

Referring particularly to FIG. 1*a*, connector system 100 of the present invention generally includes connector 102, connector cover 104, connector to RJ jack 106, connector to connector jack 108 and RJ adapter 110.

Referring to FIGS. 1*b*-13, connector 102 is adapted for connection to twisted pair of cable 112. Connector 102 generally includes pair separator 114 and strain relief 116.

In one aspect of the invention, pair separator 114 takes the form of a generally rectangular prism having smaller sides 118, larger sides 120 and ends 122. Ends 122 include first end 124 and second end 126. First end 124 defines channels 128. In one aspect of the inventions there are four channels 128. Second end 126 defines hole 130. In one aspect of the invention, there are eight holes 130. Each channel 128 is connected to two holes 130 via conductor conduit 132.

Pair separator 114 also defines rectangular notch 134 located in one of larger sides 120 and wall structures 136, each located on one of smaller sides 118. Pair separator 114 also defines slots 138. Each of slots 138 is in communication with a conductor conduit 132 near the end of a hole 130. In one aspect of the invention, there are two slots 138 on each of smaller sides 118 and larger sides 120.

FIGS. 1*b*-13 depict a non-conductive, typically injected molded part, pair separator 114. Pair separator's 114 design and shape make up the primary body of this connector that attaches to twisted pair cable 112. Pair separator 114 may be a prism with some rounded edges to create a desired smooth profile. It is design to be small and substantially dimensionally equivalent to the diameter of the twisted pair cable 112 that it attaches to.

Pair separator 114 has two smaller sides 118, two larger sides 120 and two opposing ends 122. First end 124 has four channels 128 that extend into the body of Pair Separator 114. Second end 126 is opposite first end 124 and has eight holes 130 that also extend creating channels 128 into the interior of the Pair Separator body. Rectangular notch 134 partially extends into Pair Separator 114 from second end 126 in a position that creates a window on one of smaller sides 118 or larger sides 120 of Pair Separator 114. Occurring within the interior of Pair Separator, the four channels 128 of first end 124 each individually split into two channels that that communicate with eight holes 130 of second end 126.

Pair Separator 114 maintains the quadrant spacing and isolation of the four twisted pairs 140 substantially continuing the arrangement within the cable jacket. As will be shown, the channels 128 of first end 124 accept the conductors of a twisted pair cable 112 such that one pair occupies one channel 128 entering into first end 124. As the cable conductors are pushed further into Pair Separator 114, the individual conductors that make a pair are split apart such that each individual conductor protrudes down its own hole 130 that opens through second end 126. In some embodiments, prior to inserting the conductors, it is desirable to have the conductors of each pair pre-oriented and slightly separated for a short length to aid in positioning of the proper conductor into the proper channel 128. The channels 128 on first end 124 are shaped and designed to accept the cross sectional profile of two twisted conductors while the holes 130 of second end 126 are sized and shaped to accommodate an individual conductor.

As will be shown, rectangular notch 134 in second end 126 serves as a guide or key to orient the connector 102 to assure that the continuity of cable pairs is maintained through the connector 102 termination.

The four remaining sides of the Pair Separator include smaller sides 118 and larger sides 120. Common to each of smaller sides 118 and larger sides 120 are two rectangular windows 135 that are equally sized and extend into Pair Separator 114. Rectangular windows 135 are positioned and aligned such that each extends into and opens to one of the eight channels 128. As will be shown, rectangular windows 135 guide and hold blade contacts that pierce through the insulating jacket of the conductors making physical and electrical contact with the copper core of the conductors.

Adjacent to rectangular windows 135 in the smaller sides 118 of Pair Separator 114 are protruding wall structures 136 that have a ramped surface facing second end 126 of Pair Separator 114. As will be shown, opposing wall structures 136 act as catches to a latch that will secure the connector into the jack port when it is terminated to the jack.

Two slots 138 exist near first end 124 of Pair Separator 114 on both of the larger sides 120. These slots 138 are intended to be retention features that interlock and hold strain relief 116 that encapsulates first end 124 of Pair Separator 114, the cable interface that enters into first end 124, and a portion of the length of the twisted pair cable 112.

Assembly of the Connector to the Cable

FIGS. 5-14 illustrate the sequential procedure of terminating connector to the cable 102 and assembly of connector 104.

Figures 4, 5, 6, 7:
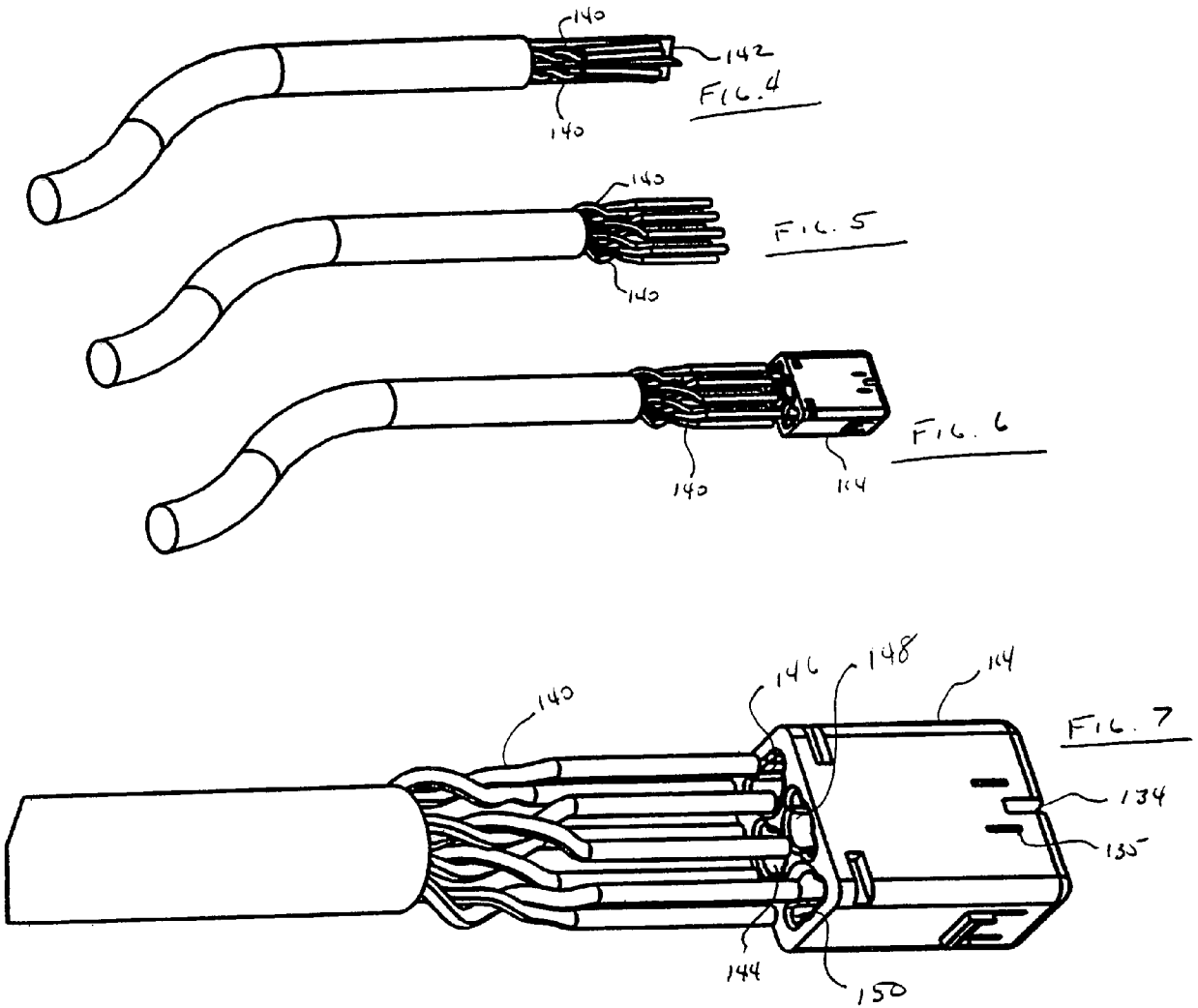
FIG. 4 is a perspective view of an explementary twisted pair cable.
FIG. 5 is a perspective view of the twisted pair cable with the pairs partially untwisted and prepared for insertion into the pair separator.
FIG. 6 is a perspective view of the twisted pair cable conductors prepared for insertion into the pair separator.
FIG. 7 is an enlarged view taken from FIG. 6.

Referring to FIG. 4, the outer insulator jacket of twisted pair cable 112 is stripped back a specified distance, exposing twisted pairs 140 and center divider 142. Care is taken not to disrupt the twist of twisted pairs 140 for a specified distance from the end of the cut cable jacket. Referring to FIG. 5, divider 142 that extends down the center of twisted pair cable 112, if applicable, is trimmed back as close to flush as possible with the cut outer cable jacket. Also shown in FIG. 5, the ends of the cable conductors are prepped into the approximate position and orientation as shown. Twisted pair #1, typically the blue pair, is oriented into a position that aligns with first channel 144 of the Pair Separator 114. Twisted pair #2, typically the orange pair, aligns with second channel 146 of Pair Separator 114, and twisted pairs #3 & #4, typically the green and brown pair respectively, align respectively with third channel 148 and fourth channel 150. As stated there is a required and specified length of undisturbed twist extending out of the outer cable jacket before the conductor leads 152 are straightened out and aligned with their appropriate positions in Pair Separator 114. The straight length of each conductor lead 152 should be enough to protrude out of holes 130 at second end 126 of pair separator 114 when conductor leads 152 are fully pushed into pair separator 114. The excess length is not critical because the conductor ends are trimmed flush with second end 126 at the end of the assembly.

Figures 8, 9, 10:
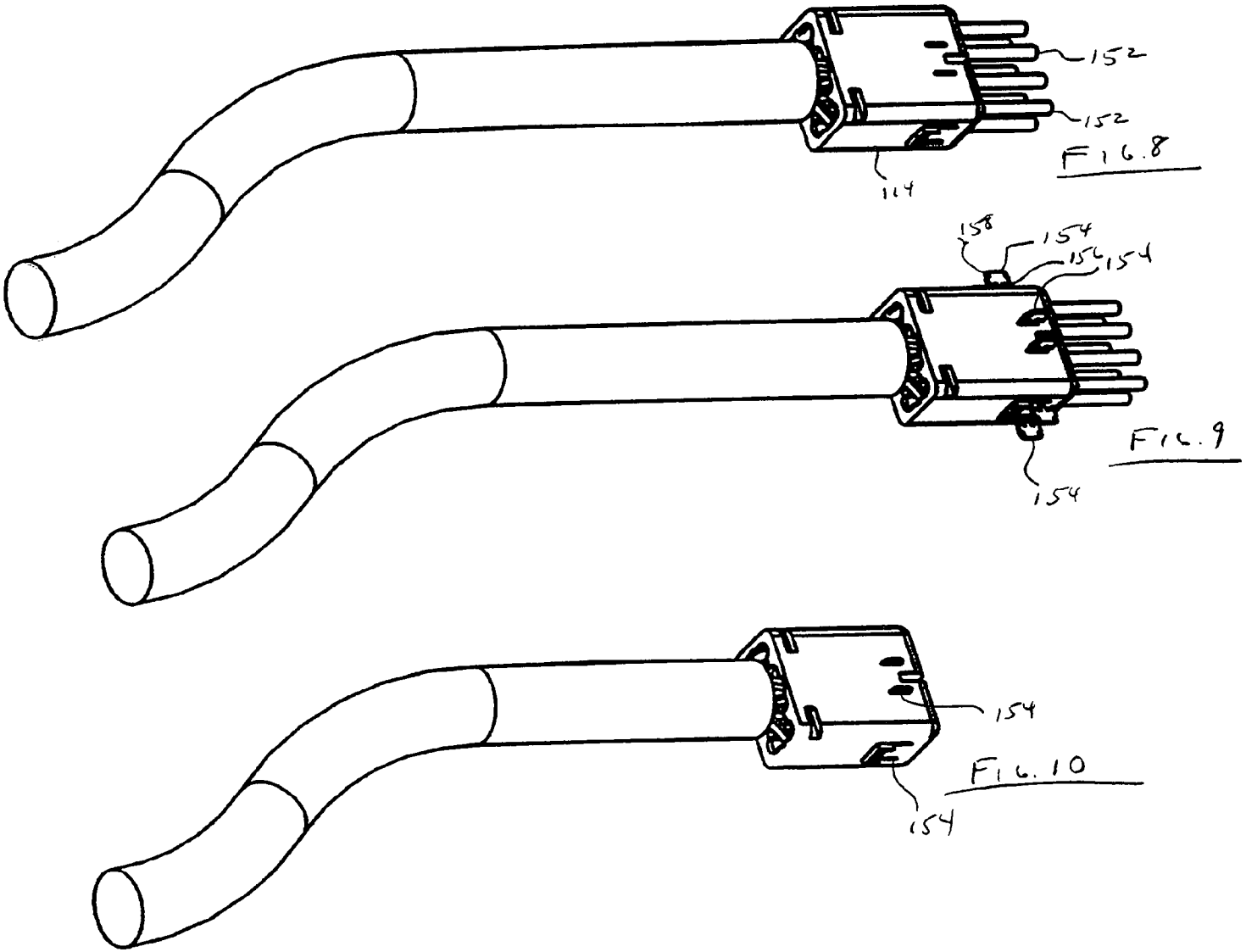
FIG. 8 is a perspective view depicting the twisted pairs inserted into the pair separator.
FIG. 9 is a perspective view of the twisted pair cable, the pair separator and blade contacts about to be inserted into the pair separator.
FIG. 10 is a perspective view of the assembled twisted pair cable, pair separator and blade contacts.

FIG. 8 illustrates pair separator 114 being pushed into its final position with the conductor leads 152 extending out of second end 126 of Pair Separator 114. The specified length of twist of the cable pairs extending out of the cable jacket coincides with the depth of the four channels 128 in first end 124 of Pair Separator 114 prior to splitting into the eight channels 128 that extend out second end 126. It is in this that the goal of controlling and maintaining the twist to a position very close to the open rectangular windows 135 in the eight channels 128 is achieved.

FIGS. 9-10 depict how blades contacts 154 are positioned and inserted into rectangular windows 135. Referring to FIG. 10, blade contacts 154 have all been pressed or seated into their final position in rectangular windows 135. At this point a spear feature 156 of the blade contact 154 has pierced and makes contact with the conductive core of the conductor leads 152 and blade head 158 protrudes out Pair Separator 114 a set distance.

Figures 11, 12, 13:
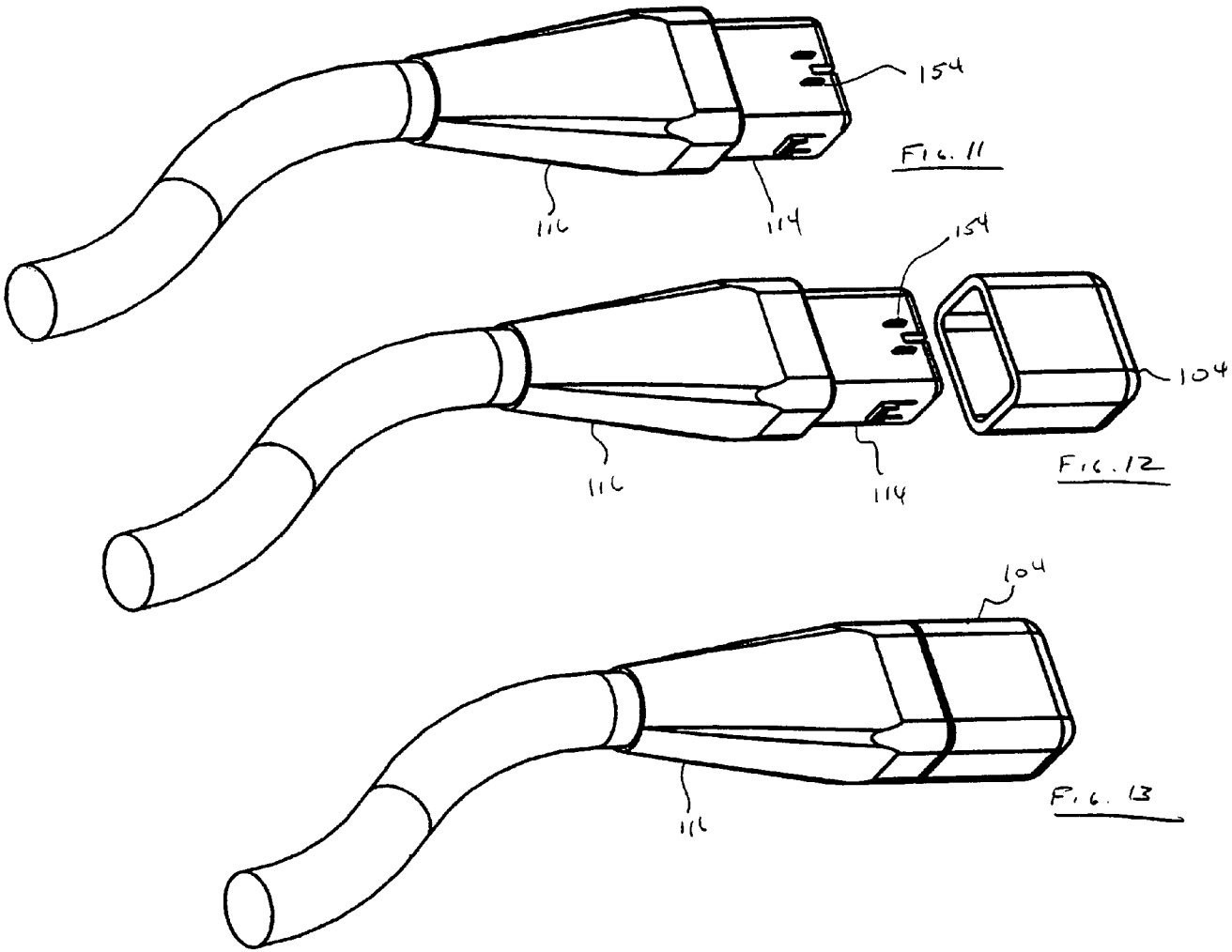
FIG. 11 is a perspective view of the twisted pair cable and pair separator assembled with a strain relief to complete a connector in accordance with the present invention.
FIG. 12 is a perspective view of the connector and connector cover in accordance with the present invention.
FIG. 13 is a perspective view of the connector and connector cover with the connector cover in place.
Figures 14, 15, 16, 17:
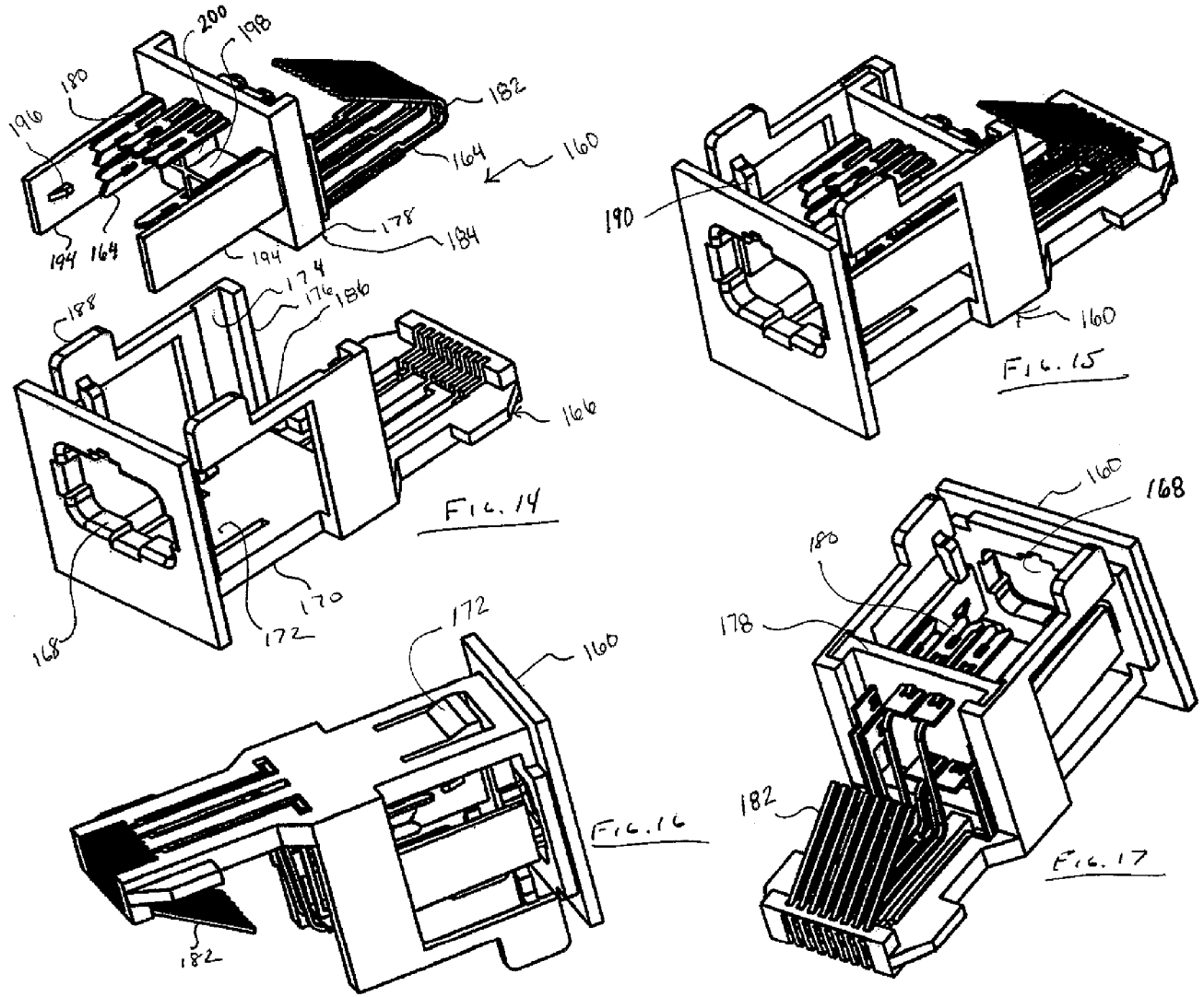
FIG. 14 is a partially exploded perspective view of an insert for a connector to RJ jack in accordance with the present invention.
FIG. 15 is a perspective view of the assembled insert.
FIG. 16 is an inverted perspective view of the inspector insert in accordance with the present invention.
FIG. 17 is another perspective view of the insert in accordance with the present invention.

FIGS. 11-13, illustrate the final steps to assembling connector 102 to twisted pair cable 112. In FIG. 11, a flexible Strain Relief 116 is added to the assembly. This can be insert molded where the Pair Separator body 114 and a portion of twisted pair cable 112 are held securely in a mold base (not shown) and the plastic material of the Strain Relief 116 is injected into a cavity that defines the shape of strain relief 116. This method creates very secure support for the twisted pair cable 112 to connector 102 interface. In another aspect of the invention, Strain Relief 116 slides onto twisted pair cable 112 and attaches to the Pair Separator 114 using snaps or latches.

FIGS. 12-13 illustrate the addition of connector cover 104 that slides over the exposed end of Pair Separator 114. Connector cover 104 protects the exposed blade contacts 154 during shipping, installation, and while connector 102 is not terminated.

Connector to RJ Jack

Referring to FIGS. 14-28 connector to RJ jack 106 generally includes insert 160, housing 162 and contact conductors 164.

Insert 160 includes insert body 166 which defines port window 168 and floor wall 170. Floor wall 170 defines cantilever latch arm 172. Insert body 166 also defines channels 174. Two opposing guides 176 extend upwardly from floor wall 170.

Contact conductors 164 may be supported by IDC plate 178. Contact conductors 164 include split fork portion 180 and spring portion 182. Split fork portion 180 extends from one side of IDC plate 178 and spring portion 182 extends from an opposing side of IDC plate 178. The assembled IDC plate 178 and contact conductors 164 formed IDC plate assembly 184.

Guides 176 further include release latch mechanisms 186. Release latch mechanisms 186 include tabs 188 and wedged legs 190.

IDC plate 178 includes base 192. Base 192 supports cantilever wall structure 194 which in turns supports catch bumps 196. IDC plate also defines walls 198 including protruding wall 200.

FIGS. 14-36 illustrate the design and features of connector to RJ jack 106 and connector to connector jack 108 that mate with the connector described above. The jacks are two port passive connecting devices. The two ports typically oppose one another.

Jack Insert Assembly

FIGS. 14-17 illustrate the components and assembly of insert 160 that is held within housing 162. At the rear of insert body 166 is port window 168 that is the opening to be the second port of connector to RJ jack into which connector 102 is inserted. Insert 160 includes floor wall 170 that extends along the length of insert body 166. This length is approximately equal to the length of connector to RJ jack 106. In floor wall 170 is cantilever latch arm 172 that has been molded generally within the confines of the floor wall 172 with a small protruding latch edge that protrudes out of the bottom of the floor wall. Cantilever latch arm 172 is used to secure the insert in the jack housing. The opposing end of the insert from the port window 168 has channels 174 and features molded into floor wall 170 to accommodate contact springs that make up the said first port of the jack or RJ45 interface port. These features will not be discussed in detail here because the RJ45 port is an industry standard and well defined. There are various means for managing the contact spring paths from the said second port of the jack to the said first port. The Figures illustrate one of many ways.

Protruding upward from the floor wall 170 generally parallel to the port window wall in the mid-section of the insert are two opposing guides 176. Guides 176 accept the IDC plate 178 and contact conductors 164. The assembly of the IDC plate assembly 184 into the insert body 166 is achieved by sliding IDC plate 178 into guides 176 and towards floor 170 of insert body 166. The motion is perpendicular to the general plane of floor wall 170. The IDC plate 178 is supported by the floor wall 170 and guides 176 serve to hold IDC plate 178 securely upright and to prevent movement of IDC plate 178 towards the front or rear of insert body 166 or connector to RJ jack 106, when assembled. IDC plate assembly 184 is not fully captured until the insert 160 is fully seated into housing 162.

Opposing each other and extending from the top of each of guides 176 in a cantilever manner are two release latch mechanisms 186. At the free ends of release latch mechanisms 186 are an upward protruding tab 188 and a downward protruding wedge leg 190. As will be described, release latch mechanisms 186 are used to release catch features that hold and prevent connector 102 from coming out when connected.

The IDC plate 178 has a base 192 that holds contact conductors 164 in a position and orientation required for Pair Separator 114 and blade heads 158 protruding from it to align and mate with slots in contact conductors 164. IDC plate 178 has two opposing cantilever wall structures 194 that roughly parallel the orientation and direction of the contact conductors 164 protruding from base 192 of IDC plate 178. On the inside or opposing sides of cantilever wall structures 194 are two protruding catch bumps 196 with ramped lead-ins. Catch bumps 196 are positioned to interlock with the protruding wall structures 136. This interlock occurs when connector 102 has been fully inserted into the connector to RJ jack 106.

A pattern of walls 198 protruding outward a specific distance from the IDC Plate base 192 serve as stop features to prevent connector 102 from being inserted to far. The tops of walls 198 act to stop Pair Separator 114 when inserted into the jack port. Protruding wall 200 extends further from base 192 than walls 198. Protruding wall 200 functions as a keying device to assure connector 102 is inserted correctly. Protruding wall 200 slides into rectangular notch 134. If connector 102 is inserted 180° out of proper orientation, it will bottom out on protruding wall 200 preventing the blade contacts 154 from making contact with contact conductors 164 and release latching mechanism 186 from interlocking.

Jack Assembly

Figures 18, 19, 20, 21:
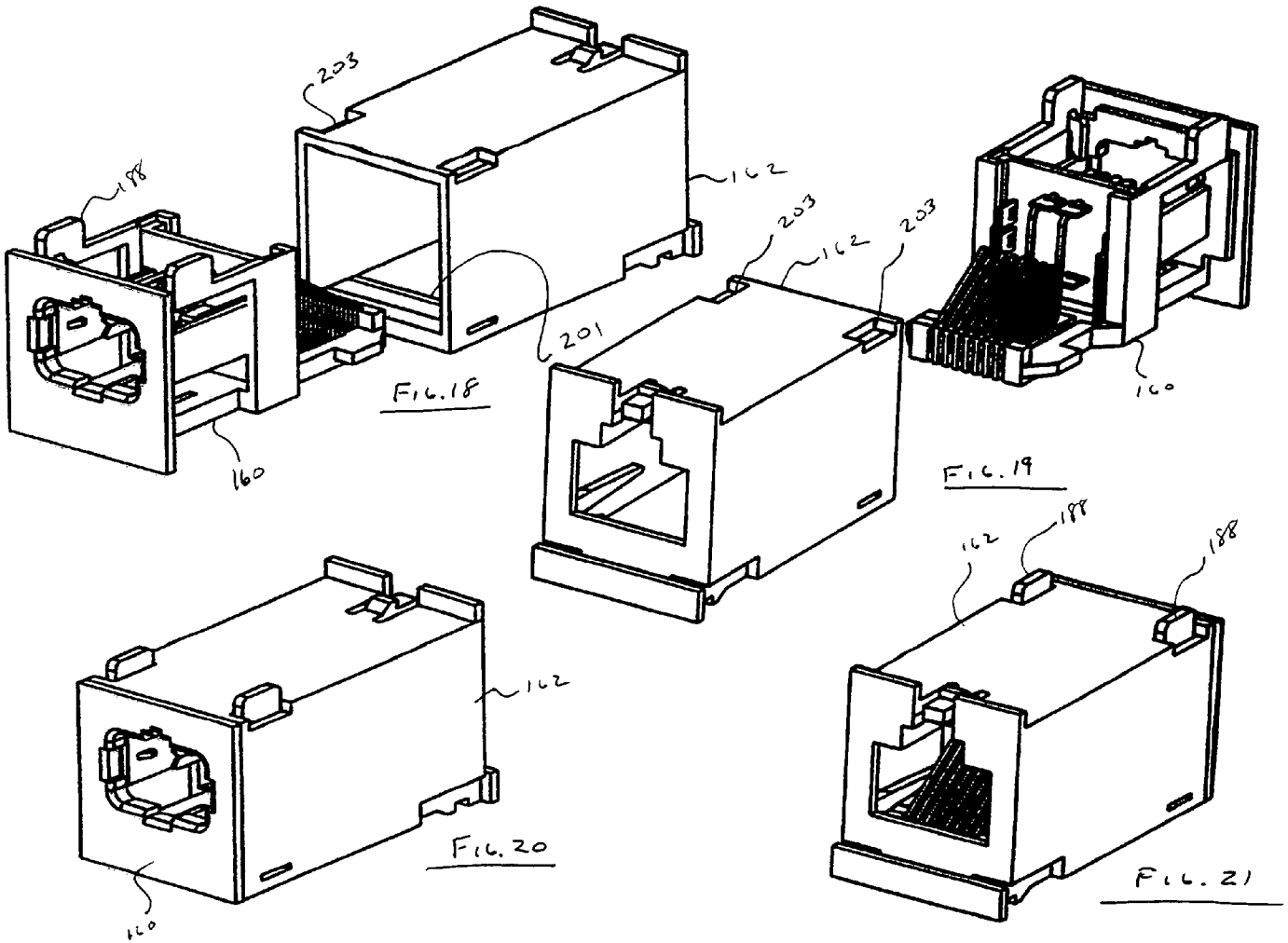
FIG. 18 is a partially exploded perspective view of a connector to RJ jack in accordance with the present invention.
FIG. 19 is a rear partially exploded perspective view of a connector to RJ jack in accordance with the present invention.
FIG. 20 is a perspective view of the connector to RJ jack in accordance with the present invention.
FIG. 21 is a perspective view from the RJ port side of the connector to RJ jack in accordance with the present invention.
Figure 23:
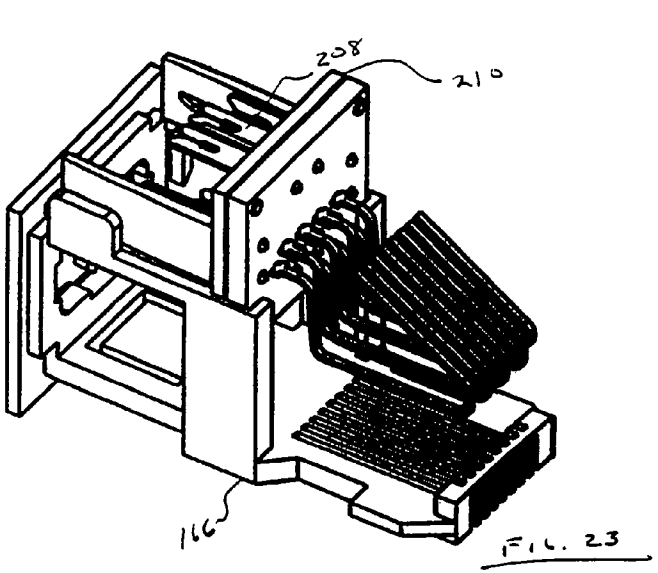
FIG. 23 is a perspective view of the insert in a partially assembled state.
Figure 25:
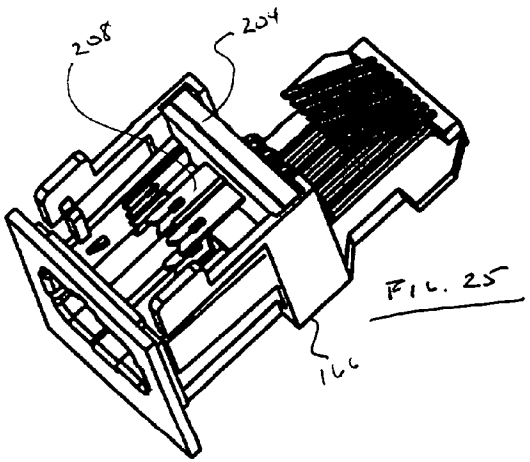
FIG. 25 is another perspective view of the insert in accordance with the present invention.
Figure 22:
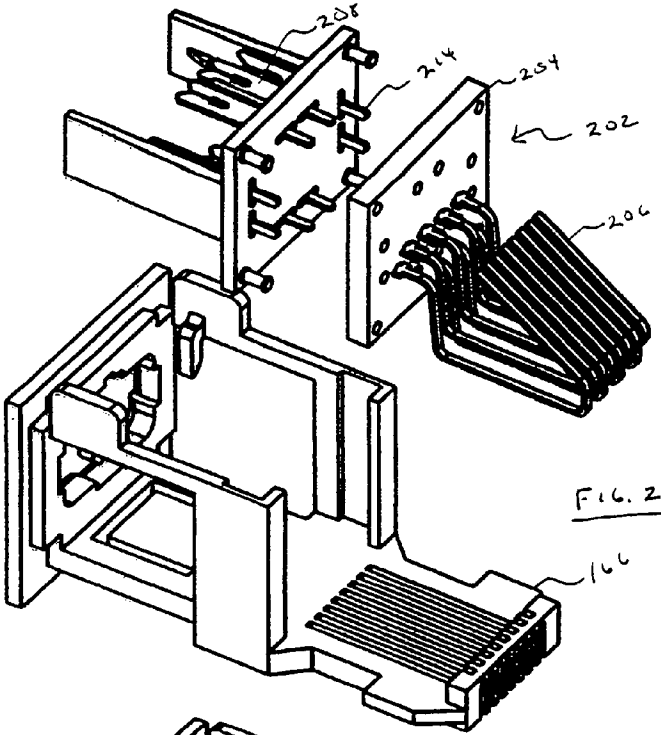
FIG. 22 is a partially exploded view of an insert in accordance with another embodiment of the present invention.
Figure 24:
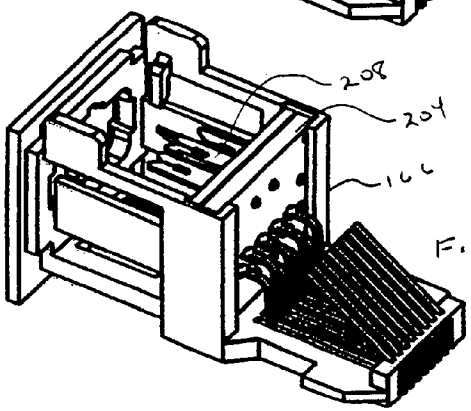
FIG. 24 is a perspective view of the insert in accordance with the present invention.

The assembly of the connector to RJ jack 106 is shown in FIGS. 18-21. FIGS. 18-19 depict the assembled insert 160 aligned and oriented in a position to be inserted into the back of the jack housing 162. FIG. 18 depicts this from the back of connector to RJ jack 106 and FIG. 19 is from the front of connector to RJ jack 106. Insert 160 slides into housing 162 until cantilever latch arm 172 snaps into the groove 201. At this point insert 160 is fully captured inside housing 162 and cannot be removed unless cantilever latch arm 172 is overcome.

As insert 160 is slid into the cavity of housing 162, tabs 188 deflect downward. They deflect to this position until they slide into alignment with windows 203. When insert 160 is fully slid into housing 162, tabs 188 recoil to their original state such that the tabs 188 protrude from windows 203 and above the top wall of the jack housing. FIGS. 20-21 illustrate the complete assembled connector to RJ jack 106 from the same two views shown above.

In another embodiment depicted in FIGS. 22-25 insert 160 includes printed circuit board assembly 202. Printed circuit board 204 spring contacts 206, split fork contacts 208 and IDC plate 210. In this embodiment spring contacts 206 are electrically and mechanically connected to printed circuit board 204. Split fork contacts 208 are mechanically supported in IDC plate 210 and extend outwardly on both sides of IDC plate 210. Split fork contacts 208 include split fork portion 212 and tail portion 214. IDC plate 210 mates with printed circuit board 204 to mechanically and electrically connect spring contacts 206 to spilt fork contacts 208. Printed circuit board 204 and IDC plate 210 together fit into guides 176 as does IDC plate 178.

Printed circuit board (PCB) 204 provides the signal path from split fork contacts 208 which include split fork portion 212 and tail portion 214 to RJ45 spring contacts 206. The placement of split fork contacts 208 into the PCB 204 can be accomplished by re-flow soldering methods or an interference press fit design between the PCB 204 plated thru holes and the tail portion 214. It is also possible that this is done with a combination of the two methods, for example one type of contact is re-flow soldered into position and the other type is press fit into place.

As shown, the assembly of IDC plate 210, split fork portion 212, tail portion 214, and PCB 204 create a sub assembly that slides into guides 176 of the jack insert 160. The fully assembled jack insert 160 can then be assembled into the jack housing 162 in the same manner as previously described. Advantages that may be realized in using a PCB 204 connector to RJ jack 106 center around signal path tuning and compensation control that can be achieved thru the circuit trace paths on the PCB 204. This can be important to controlling the cross talk between pairs as the signal is transmitted through connector 102 and connector to RJ jack 106.

Mating the Connector to the Jack.

Figure 27:
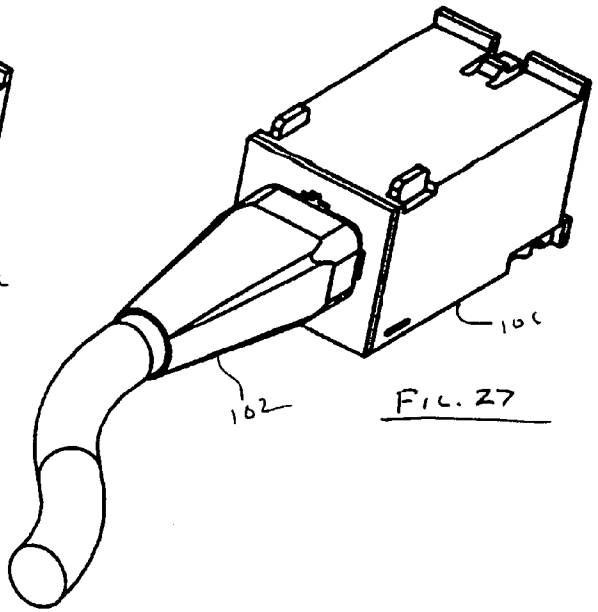
FIG. 27 is a perspective view of a connector and connector to RJ jack coupled together in accordance with the present invention.
Figure 26:
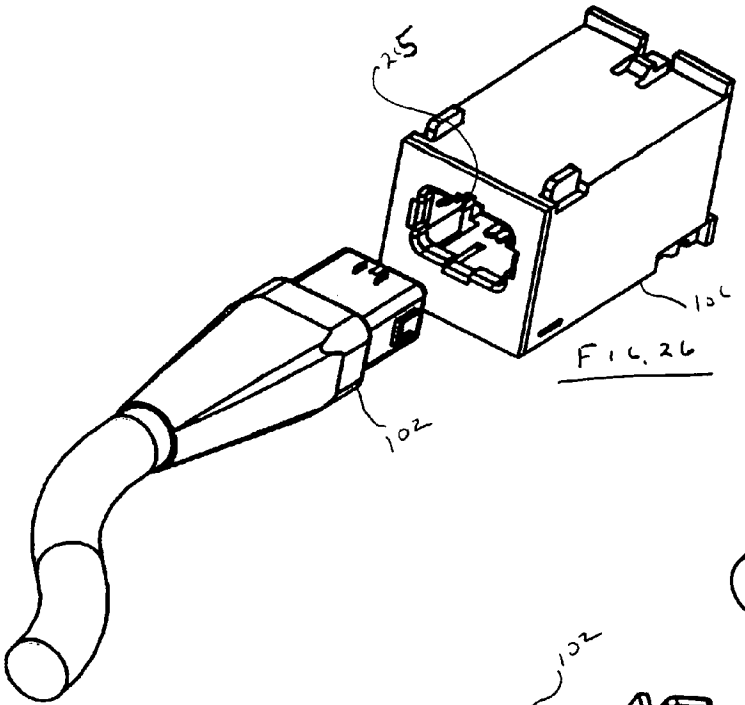
FIG. 26 is a perspective view of a connector and connector to RJ jack in the process of being connected in accordance with the present invention.
Figure 28:
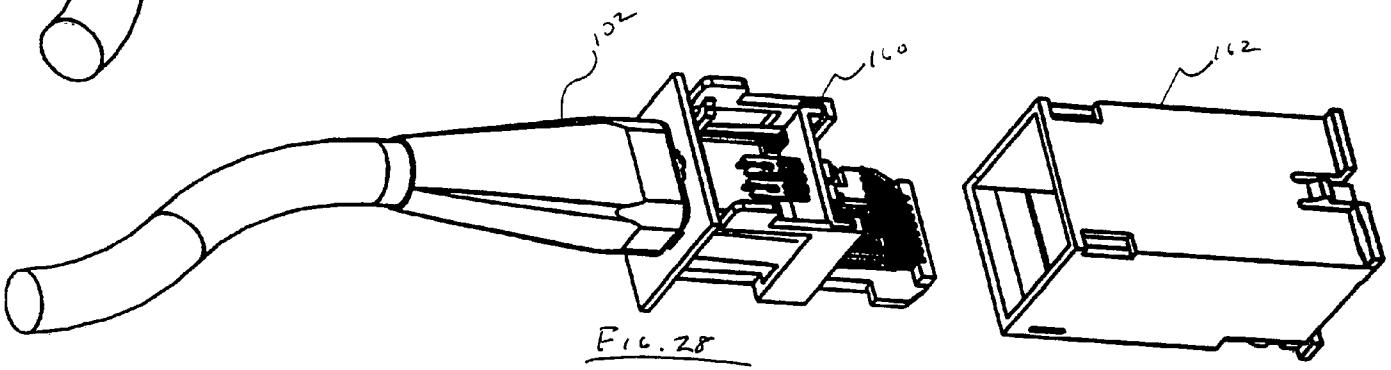
FIG. 28 is a perspective view of a connector coupled to a connector to RJ jack in accordance with the present invention with the connector to RJ jack partially exploded for clarity.
Figure 30:
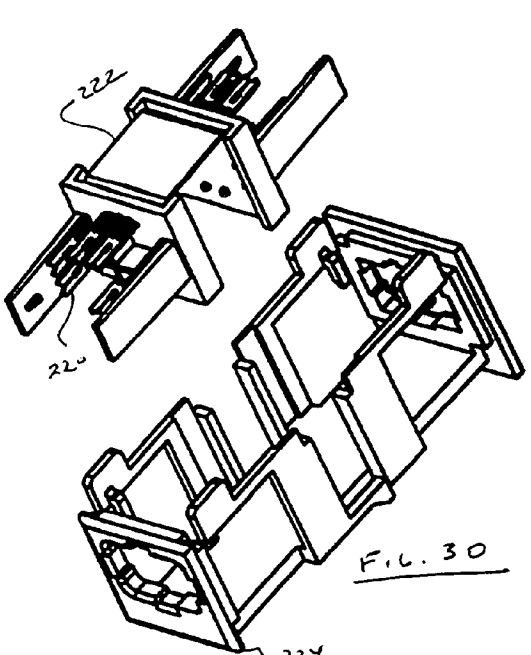
FIG. 30 is a partially exploded view of the insert depicted in FIG. 29.
Figure 32:
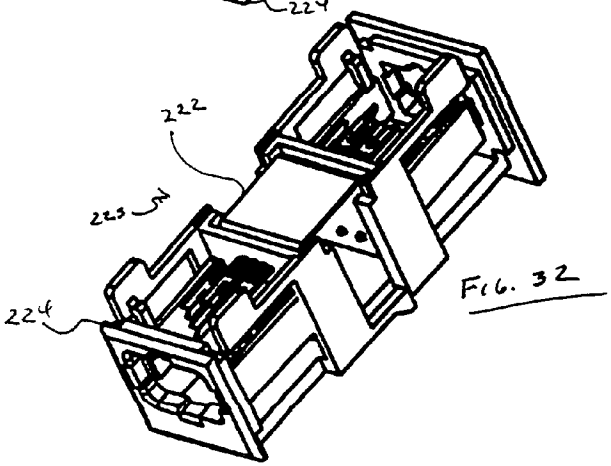
FIG. 32 is another perspective view of the assembled insert as depicted in FIGS. 29 and 30.

The connection between the jack and connector is made as illustrated in FIGS. 26-28. Referring to FIG. 26, connector 102 is aligned and oriented into position to be inserted into the port connector to RJ jack 106. Note rectangular notch 134 of Pair Separator 114 of connector 102 aligns with notch 215 of connector to RJ jack 106. This assures connector 102 is oriented correctly for insertion. FIG. 27 shows connector 102 fully inserted and terminated with connector to RJ jack 106.

In FIG. 28, the mated connector 102 and jack insert 160 are depicted backed out of housing 162 for clarity to illustrate how the contact blades heads 158 of connector 102 mate with the IDC split fork contact 208. Blade contacts 154 are shown seated into the split fork contacts 208. This creates a high pressure squeezing force between the two contact members. (In actual usage, the insert cannot be pulled out of the jack as shown in this view).

Connector 102 can be removed from connector to RJ jack 106 by pressing down on two tabs 188, protruding from housing 162, and pulling connector 102 straight out. When tabs 188 are pressed down, the wedge leg 190 below tab 188 comes into contact with the cantilever wall structure 194. As tabs 188 are pressed to flush with the top surface of the jack, wedge leg 190 displace cantilever wall structures 194 outward the required distance to disengage the interlock between the catch bumps 196 and the protruding wall structures 136. In this position, connector 102 can be pulled straight out of the port with the only retention to be overcome arising from the friction of the IDC split fork contacts 208 squeezing the blade contacts 154 of connector 102. When connector 102 is free of the jack, the tabs 188 recoil to their undeflected position.

Two Connector Port Jack

Connector to connector jack 108 is a two port connection device used to connect two terminated cable ends.

Referring to FIGS. 29-36, connector to connector Jack 108 is depicted. Connector to connector Jack 108 includes connector to connector housing 216, IDC plates 218, two sets of split fork contacts 220 and flexible printed circuit 222.

FIGS. 29-32 illustrate insert assembly 902. As can be seen, the insert is substantially a mirror structure of the previously described insert. The structure of the IDC plates 218 and split fork contacts 220 are similar. The release latch mechanisms 186 and tabs 188 are the same on both ports. The primary differences center around how IDC plates 218 and split fork contacts 220 are connect electrically. This is achieved by use of flexible printed circuit 222. Flexible printed circuit 222, similar to a printed circuit board, has electrical trace paths that electrically couple one tail portion 214 to the appropriate opposing tail portion 214. The difference is that where a printed circuit board is a rigid structure, flexible printed circuit 222 is able to bend and flex.

Figure 29:
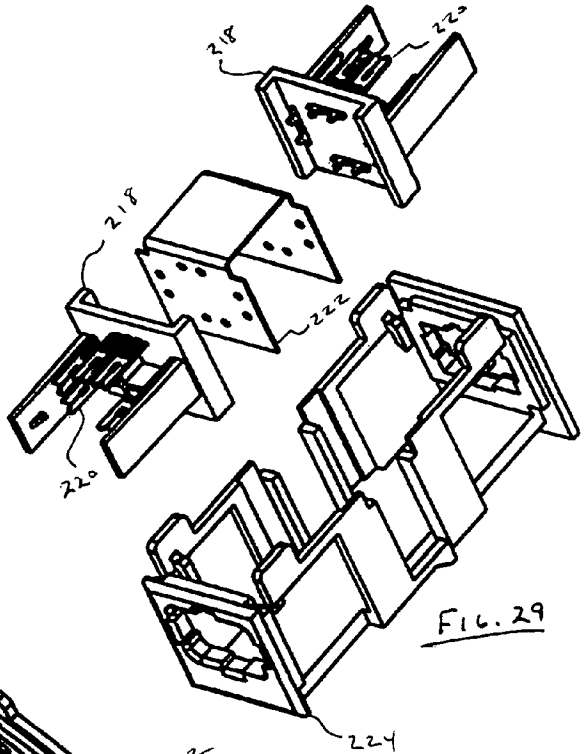
FIG. 29 is an exploded perspective view of an insert for a connector to connector jack in accordance with the present invention.
Figure 31:
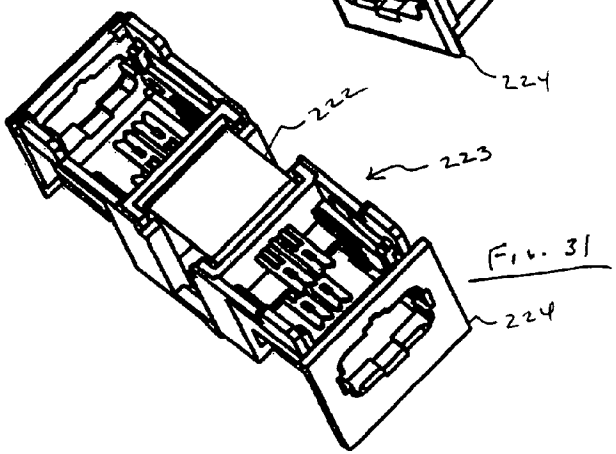
FIG. 31 is a perspective view of the assembled insert depicted in FIGS. 29 and 30.

Once the IDC plates 218 are soldered to flexible printed circuit 222 as shown in FIG. 29, this sub assembly can then be slid into the guides 176 similar to the previously described design. This assembly then creates the insert assembly 223.

Figures 33, 34, 35:
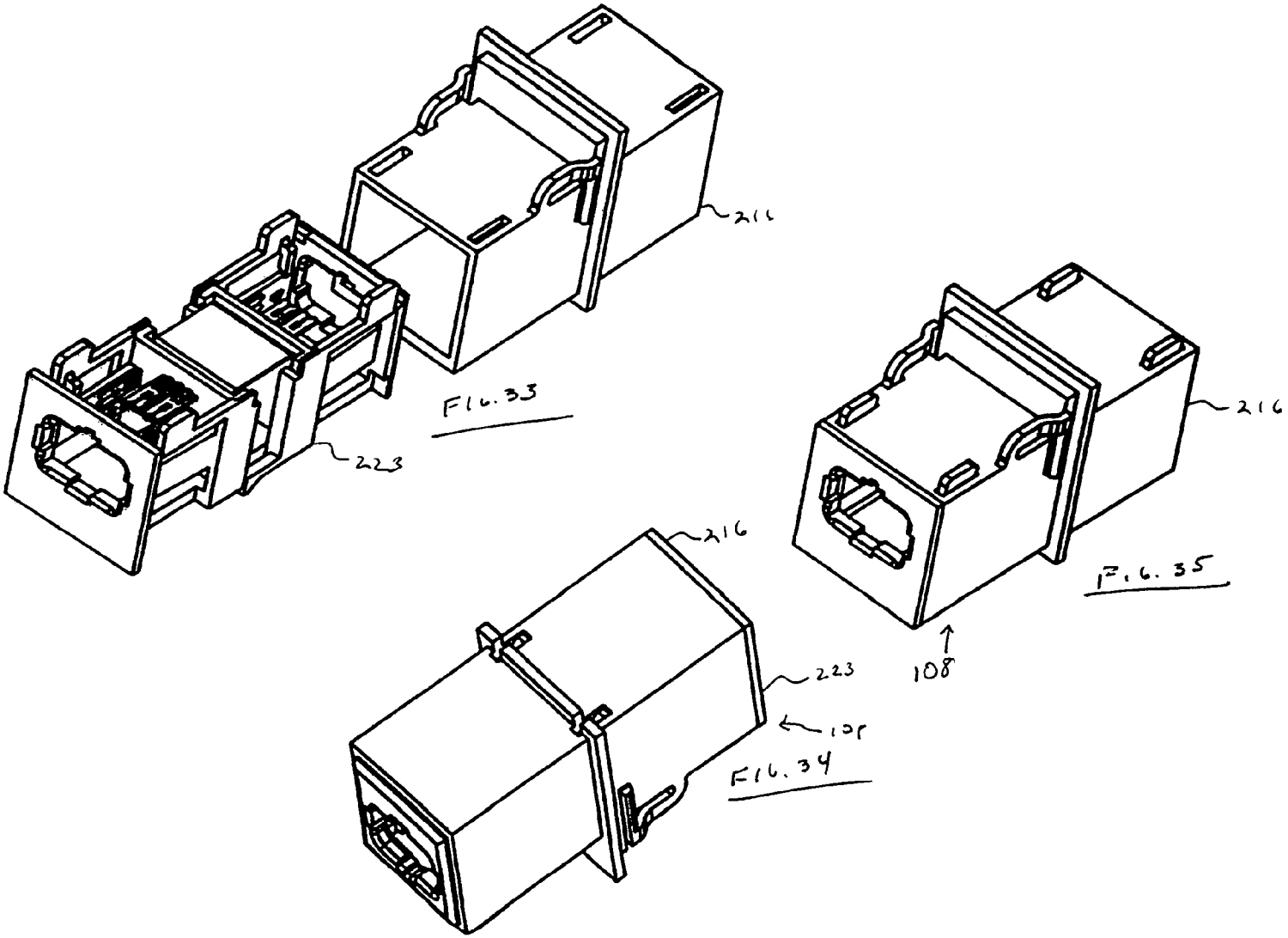
FIG. 33 is an exploded perspective view of the connector to connector jack in accordance with the present invention.
FIG. 34 is a perspective view of the connector to connector jack depicting the connector port in accordance with the present invention.
FIG. 35 is another perspective view of the connector to connector jack in accordance with the present invention.

Referring to FIGS. 33-35, insert assembly 223 is aligned and inserted into the dual jack housing 1080. The perimeter 224 of the first port to enter the jack housing 162 has been reduced in size to allow it to slide freely through the interior of housing 162. The port window 168 remains the same. The release latch mechanisms 186 and tabs 188 deflect as they enter housing 162 but recoil into the open window slots at either end of the housing when the insert is full in place. Tabs 188 on both sides holds insert assembly 223 in the housing, deflects as it is inserted and then recoils into the slots 1094 on the bottom of the housing wall. FIGS. 34-35 show connector to connector jack 108 fully assembled both from a bottom view perspective and from a top view perspective.

Figure 36:
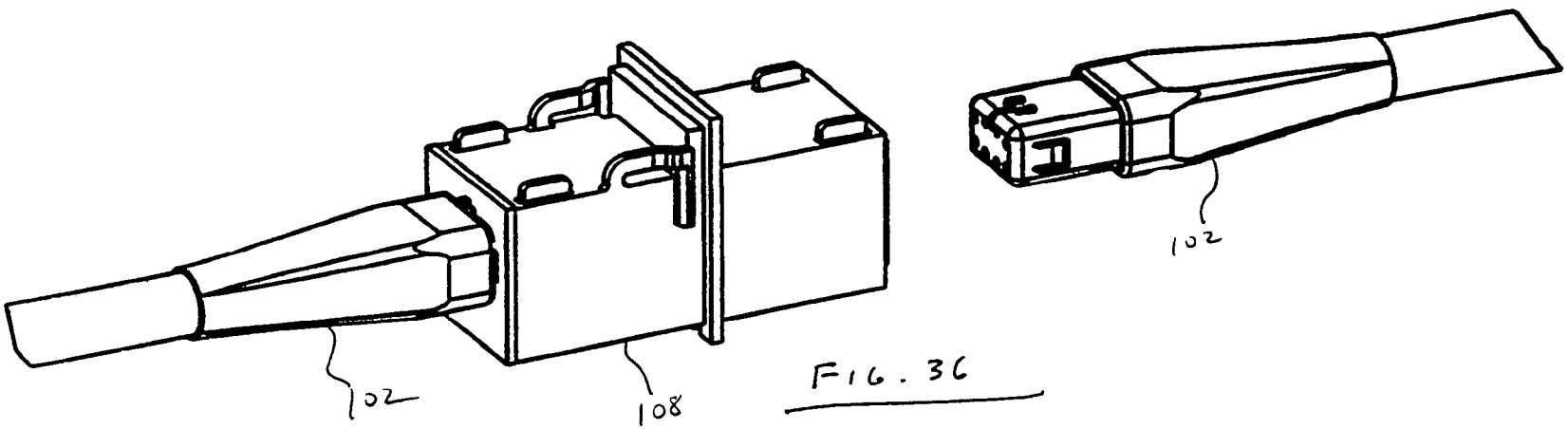
FIG. 36 is a perspective view of two connectors and a connector to connector jack in accordance with the present invention.

FIG. 36 illustrates connector to connector jack 108 coupled with two connectors 102.

RJ45 Adapter Cap Assembly

Referring to FIGS. 37-43, RJ adapter 110 generally includes adapter housing 226 and contacts 228.

Contacts 228 include first end 230, opposing end 232 and middle section 234. First end 230 defines tab 236 into which is cut slot 238 having V entry 240. Opposing end 232 defines contact fingers 242.

Figures 37, 38, 39, 40:
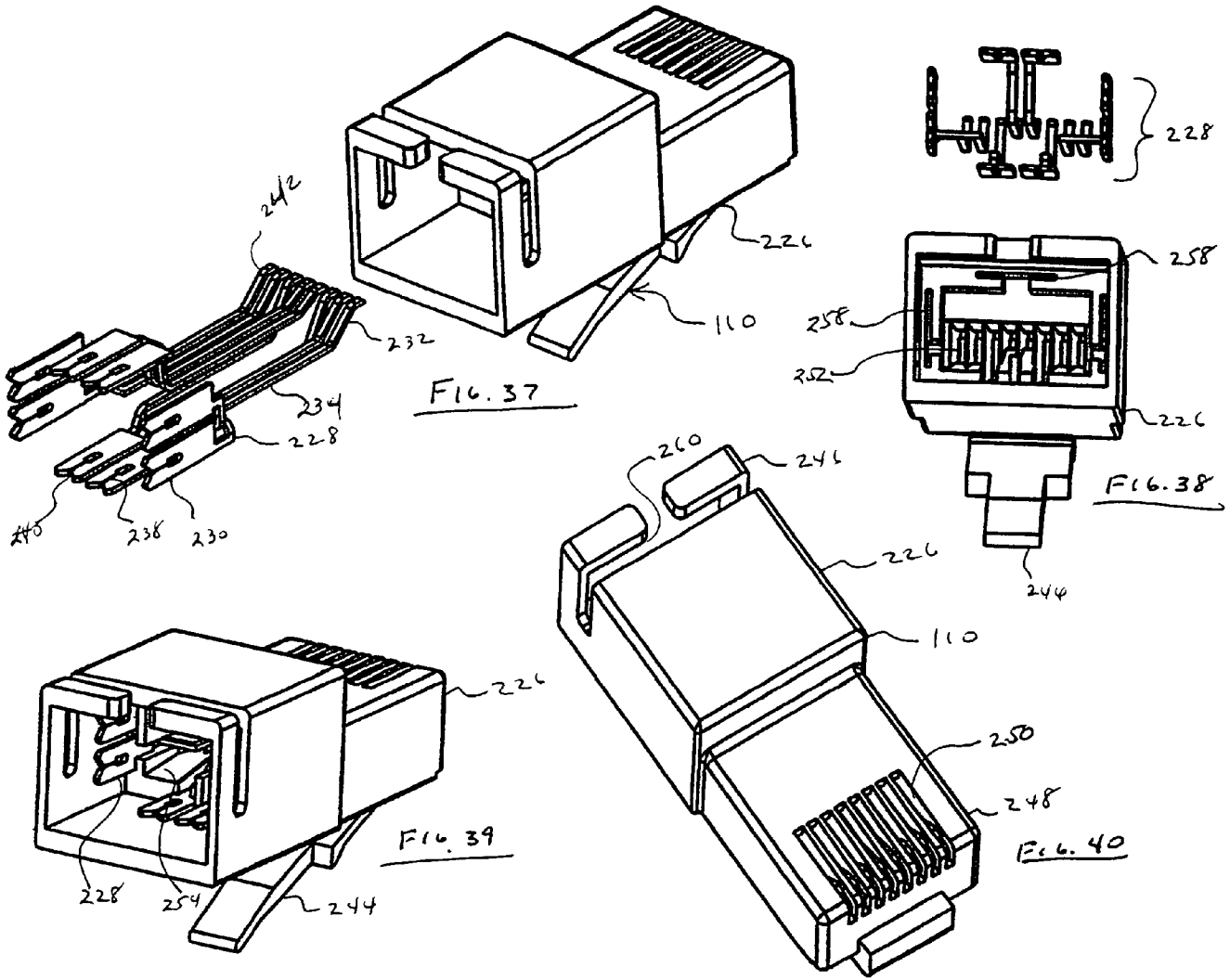
FIGS. 37 and 38 are exploded perspective views of an RJ adapter in accordance with the present invention.
FIGS. 39 and 40 are perspective views of the RJ adapter in accordance with the present invention.

Adapter housing 226 defines latching tab 244, back end 246 and front end 248. Front end 248 defines elongate windows 250. Referring particularly to FIGS. 38 and 39, back end 246 defines channels 252 having ramp features 254. Body ends 256 of tabs 236 are seated in channels 252. Back end 246 further defines slots 258 into which tabs 236 may be received. Back end 246 also defines keeper slot 260.

The electrical contacts 228 are fabricated from a copper alloy material with conductivity characteristics favorable for carrying electrical signals. The first ends 230 have a rectangular tab 236 with a slot 238 cut partially to the center of the tab and a "V" entry 240 to slot 238 from the exterior side of tab 236. Contacts 228 are commonly known as insulation displacement contacts or IDC's. IDCs are typically designed to engage a wire or conductor that is pressed into the "V" entry 240 and slot 238. When pressing an insulated wire into slot 238, the walls that border slot 238 cut through and displace the insulation material on the wire and the opposing tines of the slot 238 squeeze the conductive material of the wire, thereby making physical and electrical contact with the wire. The IDC connection type is beneficial in that it provides and maintains high pressure in the contact region creating a gas tight seal of the electrical contact region. It is naturally redundant in that both tines typically make electrical contact with the conductor material. In the case of a blade contact 154 as used in connector 102, there is no insulation to displace. The blade contact 154 simply presses into slot 238 and the two tines create an opposing squeezing contact pressure on blade contact 154.

Opposing the IDC tab ends of the contacts are a planar array of contact 242. Contact fingers 242 provide the RJ45 contact interface with the springs in the RJ45 modular jack. Their position and alignment in the RJ45 adapter housing replicate the contact point positions typical of all RJ45 modular connectors as well as the requirements specified by the standard FCC CFR 47 Part 68 Subpart F.

The middle sections 234 create a physical and electrical path between the IDC tabs and the RJ45 contact tips. The paths as shown tend to keep conductor pairs together as much as possible as well as on a common plane along the path. There may be other middle section path designs that are not shown that could improve the signal carrying characteristics of the adapter and connector assembly. These may involve a twisting or partial twist of the conductor paths within a pair or a greater degree of varying the planar paths each conductor or pair takes.

Adapter housing 226 performs a structural nesting function for holding contacts 228 securely in position as well as creates an interface structure with latching tab 244 to interface with the RJ45 port of a modular jack. Adapter housing 226 has a back end 246 that defines an open cavity to the internal features of the housing. The Adapter Housing has a front end 248 whose size shape and features are designed to fall within the requirements of the previously mentioned standard FCC CFR 47 Part 68 Subpart F. Front end 248 is the RJ45 interface end. Part of the structure of front end 248 includes latching tab 244 that also meets the requirements of the above mentioned standard. The RJ45 contact interface is created by a series of elongated windows 2115 in the front end that provide an opening for the contact fingers 242 of the RJ45 Adapter 110. It is within the region of these windows that electrical and physical contact is made between the RJ45 Adapter Cap contacts and the RJ45 modular Jack contact springs, when mated.

Back end 246 of RJ Adapter has a rectangular opening roughly equivalent to but slightly larger than the profile of connector 102. It is sized to accept connector 102 and protruding blade contact 154.

Extending into the cavity opening toward the middle of the RJ45 Adapter housing body are a series of channels 252 and ramp features 254. These features aid in guiding the contact fingers 242 and middle sections 234 into their correct positions during assembly of the electrical contacts 238 into adapter housing 226. The electrical contacts are assembled by inserting the contact tip ends into the back opening 2113 and then subsequently inserting each into it's own individual interior channel 252. The electrical contacts 228 are inserted until the bottom ends 256 of the IDC tabs are securely seated or pressed into the provided slots 258 inside the cavity of the adapter housing. When seated into these slots 258, tabs 236 are held in the correct orientation and position to accept and mate with the pre-terminated cable connector 102.

Attaching RJ Adapter to the Pre-Terminated Connector

Referring to FIGS. 41-43C, attachment of RJ adapter 110 to connector 102 is depicted. Locking Collar 262 is used to secure RJ adapter 110 to connector 102. Connector 102 is aligned and inserted into back end 246 of RJ adapter 110. Connector 102 is fully inserted into RJ adapter 110 until second end 126 of connector 102 meets walls 198 of RJ adapter 110. In this position, blade contacts 154 have fully engaged with slots 238 of contacts 228.

Locking collar 262 includes rear arms 264 and front opposing arms 265. Rear arms 264 are sized and adapted to fit into keeper slot 260. Front opposing arms 266 engage wall structures 136 of connector 102, thus providing a stop to keep connector 102 from being pulled out of RJ adapter 110. Thus assembled, connector 102 secured to RJ adapter 110 can be used as an RJ45 patch cable.

Figures 41, 42, 43A, 43B, 43C:
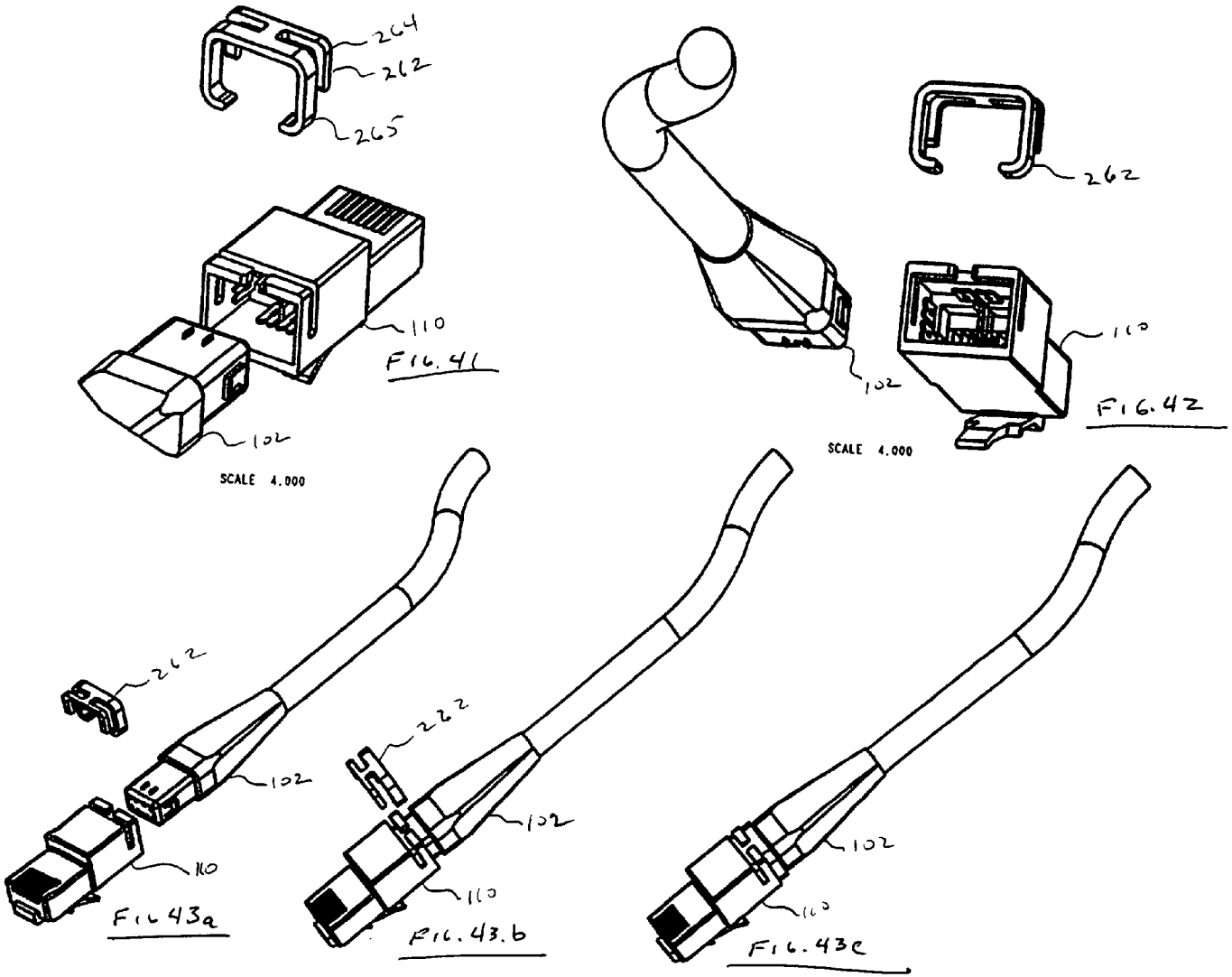
FIGS. 41 and 42 are perspective views of a connector, RJ adapter and locking clip in accordance with the present invention.
FIGS. 43*a*-43*c* are perspective views sequentially depicting the assembly of the RJ adapter connector and locking clip.

Referring to FIGS. 43A-43C, the sequence assembly is depicted.

Figure 45:
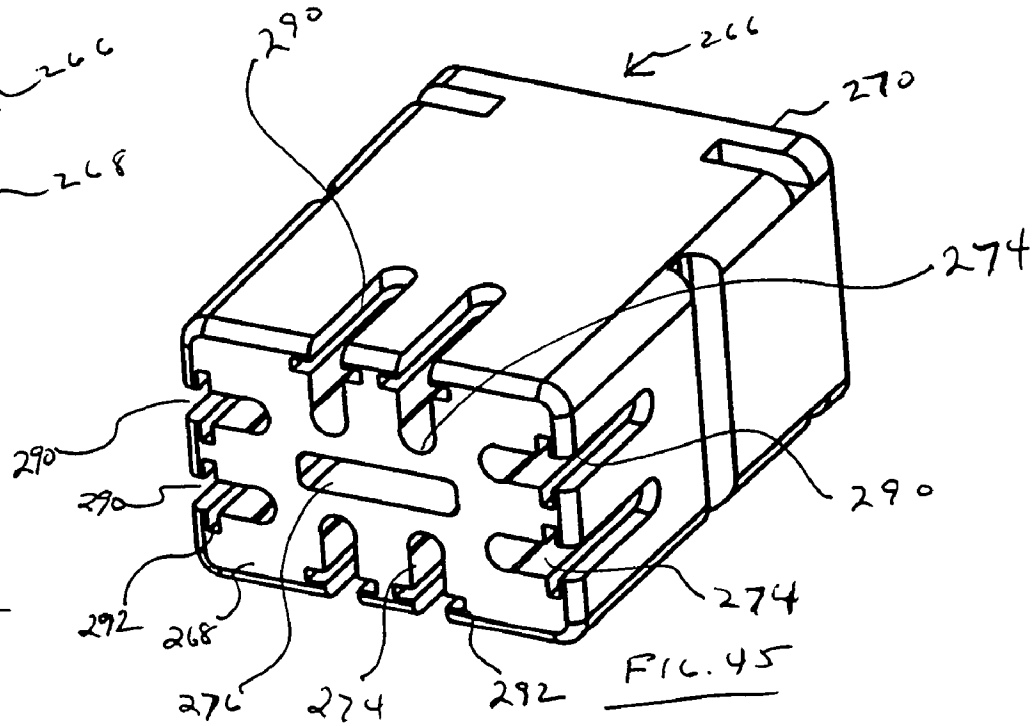
FIG. 45 is a front perspective view of the pair separator depicted in FIG. 44.
Figure 44:
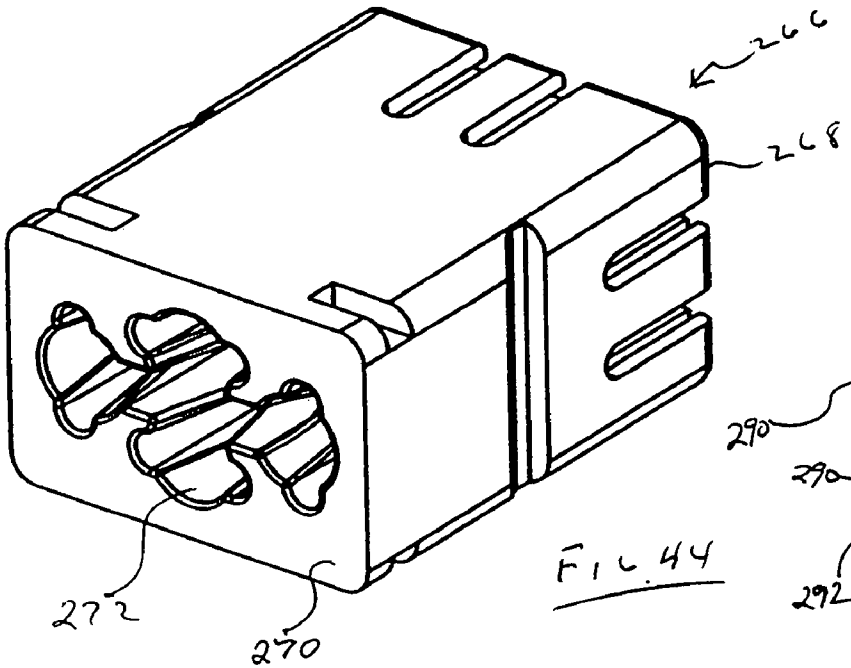
FIG. 44 is a rear perspective view of a pair separator in accordance with another embodiment of the invention.

Referring to FIGS. 44 and 45, another embodiment of pair separator 114 is depicted. IDC pair separator 266 is shaped and sized similarly to pair separator 114.

IDC pair separator 266 generally includes front end 268 and rear end 270. Rear end 270 defines four port openings 272 therein. Front end 274 defines exit ports 274 and rectangular port 276. There are eight exit ports 274 and a single centrally located rectangular port 276.

Each of port openings 272 is adapted to receive a cross sectional profile of a twisted pair connector pair and four very short lengths of the twisted pairs are straightened to separate the individual conductors of the pair into short paths parallel to each other.

Exit ports 274 will typically number eight, and provide a path through which one of each twisted pair conductor leads 152 of the port for twisted pairs 140 exit IDC pair separator 266.

Rectangular port 276 is centrally positioned and passes through IDC pair separator 266 from front end 268 to rear end 270. Rectangular port 276 provides a channel for the center plus or cross shape divider commonly found in many twisted pair cables to pass through IDC pair separator 266.

It is believed that by allowing the center plus or cross shape divider of the cable to be pushed through the IDC pair separator 266 at the time as the conductors are pushed into and through the IDC pair separator 266, less disruption occurs in the lay or twist of the conductors of the cable. Thus, in this embodiment, unlike previously described embodiments, it is not required that prior to inserting the conductor into IDC pair separator 266, that the conductors be folded back at approximately 90° angles to expose the center plus divider to allow trimming back of the center plus divider. In the previously described embodiments, it is necessary for the conductor to be returned back to their original paths to be inserted into pair separator 114. In this embodiment, the conductors and the divider are all pushed through IDC pair separator 266 simultaneously and all trimming of conductors and the divider is done after the pairs are located.

Figures 47, 48, 49:
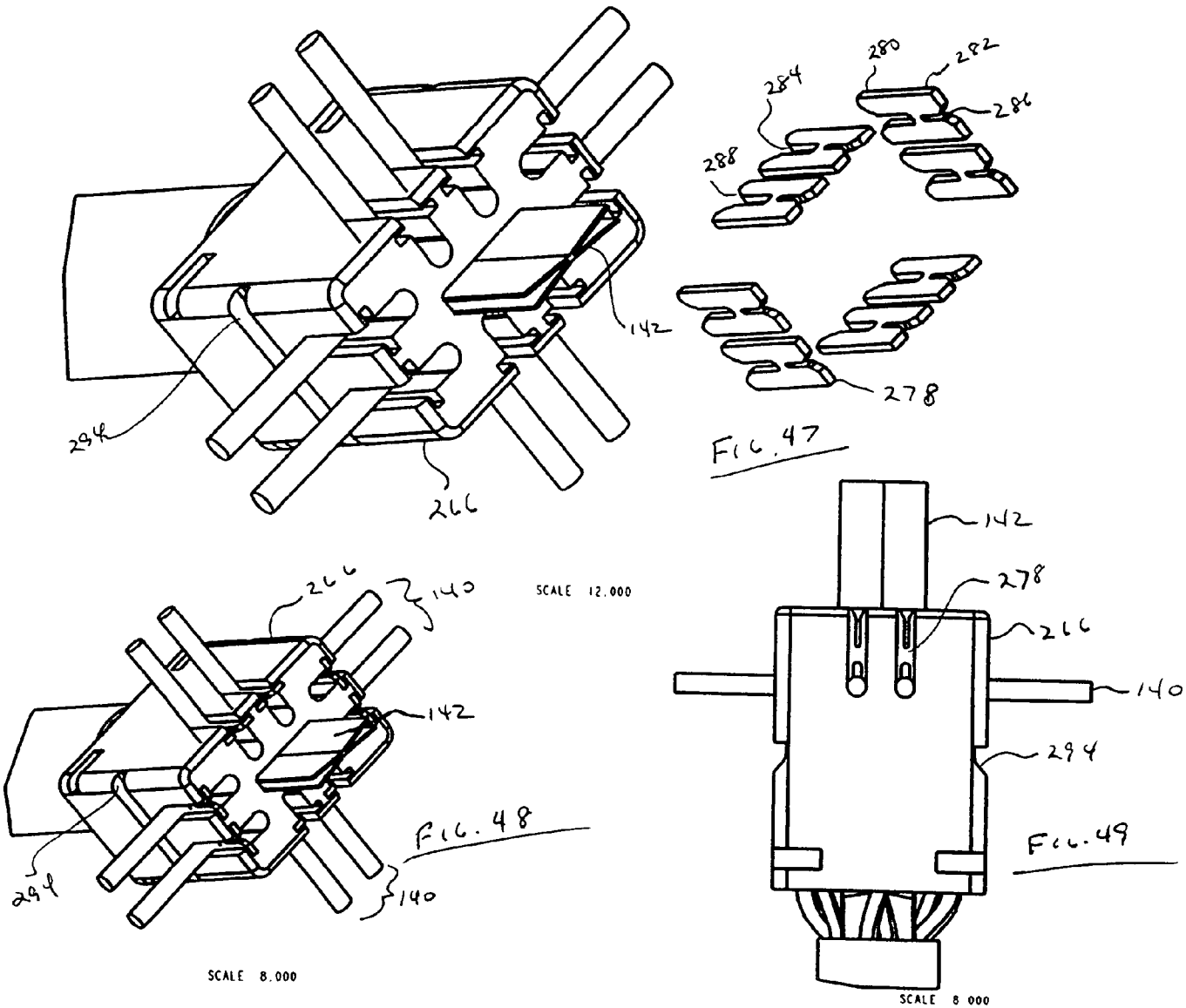
FIG. 47 is a partially exploded view of the pair separator and insulation displacement contacts in accordance with the present invention.
FIG. 48 is a perspective view of the pair separator with the insulation displacement contacts inserted.
FIG. 49 is plan view of the pair separator with the insulation displacement contacts inserted.

Referring to FIGS. 47-49, insulation displacement contacts 278 are depicted. Each of insulation displacement contacts 278 is a generally H-shaped structure comprising conductor tines 280 and connection tines 282. Conductor tines 280 define conductor slot 284. Connection tines 282 define connection slot 286. Conductor slot 284 includes a V-shaped entrance 288. V-shaped entrance 288 leads to conductor slot 284.

The conductor wire is pressed into conductor slot 284. When this is done, the insulation jacket of the conductor shears away and conductor tines 280 squeeze tightly onto the conductive core of the wire. This creates a high pressure gas tight seal connection and the springing recoil of the conductor tines 280 maintains pressure over time.

Referring to FIGS. 47, 48 and 49, front end 268 of IDC pair separator 266 defines side wall slots 290 and rectangular slots 292. Side wall slots 290 align with and merge into exit ports 274. Rectangular slots 292 open to front end 268 of IDC pair separator 266 and align about the centers of side wall slots 290. Rectangular slots 292 extend partially into IDC pair separator 266, a distance that extends beyond the length of side wall slots 290. Side wall slots 290 allow conductor wires to be pulled into a position that facilitates terminating the wire with insulation displacement contacts 278. Rectangular slots 292 support and guide insulation displacement contacts 278 into position. IDC pair separator 266 also defines inset slots 294.

Assembly Sequence and Termination of IDC Pair Separator to the Cable

FIGS. 46*a*-46*d* and FIGS. 47-51 illustrate an assembly sequence for terminating IDC pair separator 266 to a twisted pair cable.

Figures 46A, 46B, 46C, 46D:
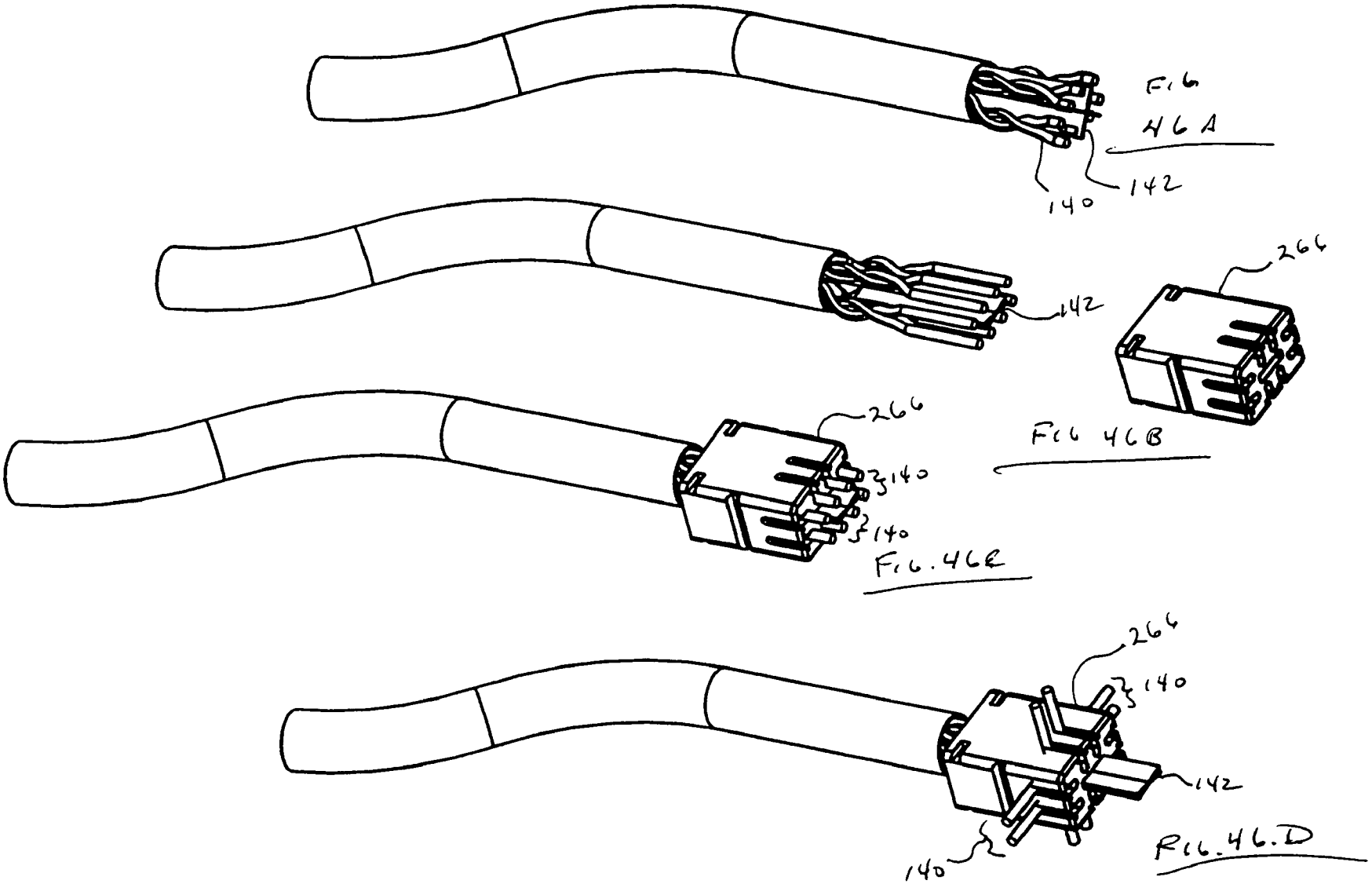
FIG. 46*a* is a perspective view of a twisted pair cable in accordance with the present invention.
FIG. 46*b* is a perspective view of the twisted pair cable with some of the twisted pairs straightened and prepared for insertion the pair separator in accordance with an embodiment of the invention.
FIG. 46*c* is a perspective view of the twisted pair cable inserted into the pair separator.
FIG. 46*d* is a perspective view of the twisted pair cable inserted into the pair separator with the twisted pairs bent at right angles and a center divider pulled through the pair separator.

FIGS. 46*a*-46*b* depict preparation of a cable and how IDC pair separator 266 is positioned onto the cable and its conductors. Referring to 46*a*, the outer jacket of the cable is removed a specified distance exposing the four conductor pairs divided by a plus shaped spacer.

Referring to FIG. 46*b*, the conductor leads are repositioned slightly to align with the four port openings 272 on front end 268 of IDC pair separator 266. Straightening the conductors slightly is required in this embodiment to feed them into and through IDC pair separator 266. This is not overly detrimental to performance because most of the straighten portion of the conductor is trimmed off at the end of the assembly process leaving the majority of the twisted conductor pairs still twisted and within the interior of IDC pair separator 266. Thus, the length of untwisted conductors within IDC pair separator 266 is very small.

Referring to FIG. 46*c*, IDC pair separator 266 is slid over the conductors of the twisted pair cable, such that where the twist of the conductors ends aligns with the location where four port openings 272 diverge into eight exit ports 274. The twisted portion of the conductor pairs should be pressed all the way to this transition point to maintain the twist relationship of the conductors as much as possible.

Referring to FIG. 46*d*, the conductor ends have been pulled back into sidewall slots 290, and outward from IDC pair separator 266 at approximately right angles. The center plus shaped divider is a flexible member and, as can be seen in FIG. 46*d*, can be transitioned from a plus shape as it enters rear end 270 of IDC pair separator 266 to a somewhat flatten X shape where it exits through rectangular port 276.

FIGS. 47-49 illustrate the assembly of insulation displacement contacts 278 to IDC pair separator 266. As can be seen, insulation displacement contacts 278 are inserted into rectangular slots 292. Insulation displacement contacts 278 are inserted so that conductor slot 284 enters rectangular slots 292 first. The size of conductor slot 284 is such that the conductor jacket is sheared away exposing and leaving the conductive core of the wire to be squeezed by conductor tines 280. Twisted pair conductors are secured within conductor slot 284 as depicted in FIG. 49.

Conductor Connection slot 286 are sized specifically to make contact with a blade type contact discussed below.

The overall size and shape of insulation displacement contacts 278 are such that they fit snugly into rectangular slots 292. When conductor tines 280 and connection tines 282 are deflected by the placement of the wire into the conductor slot 284, the tightness increases due to slight deflection of the tines.

FIG. 48 depicts insulation displacement contacts 278 fully seated into their final position in IDC pair separator 266.

Figures 50A, 50B, 50C, 51:
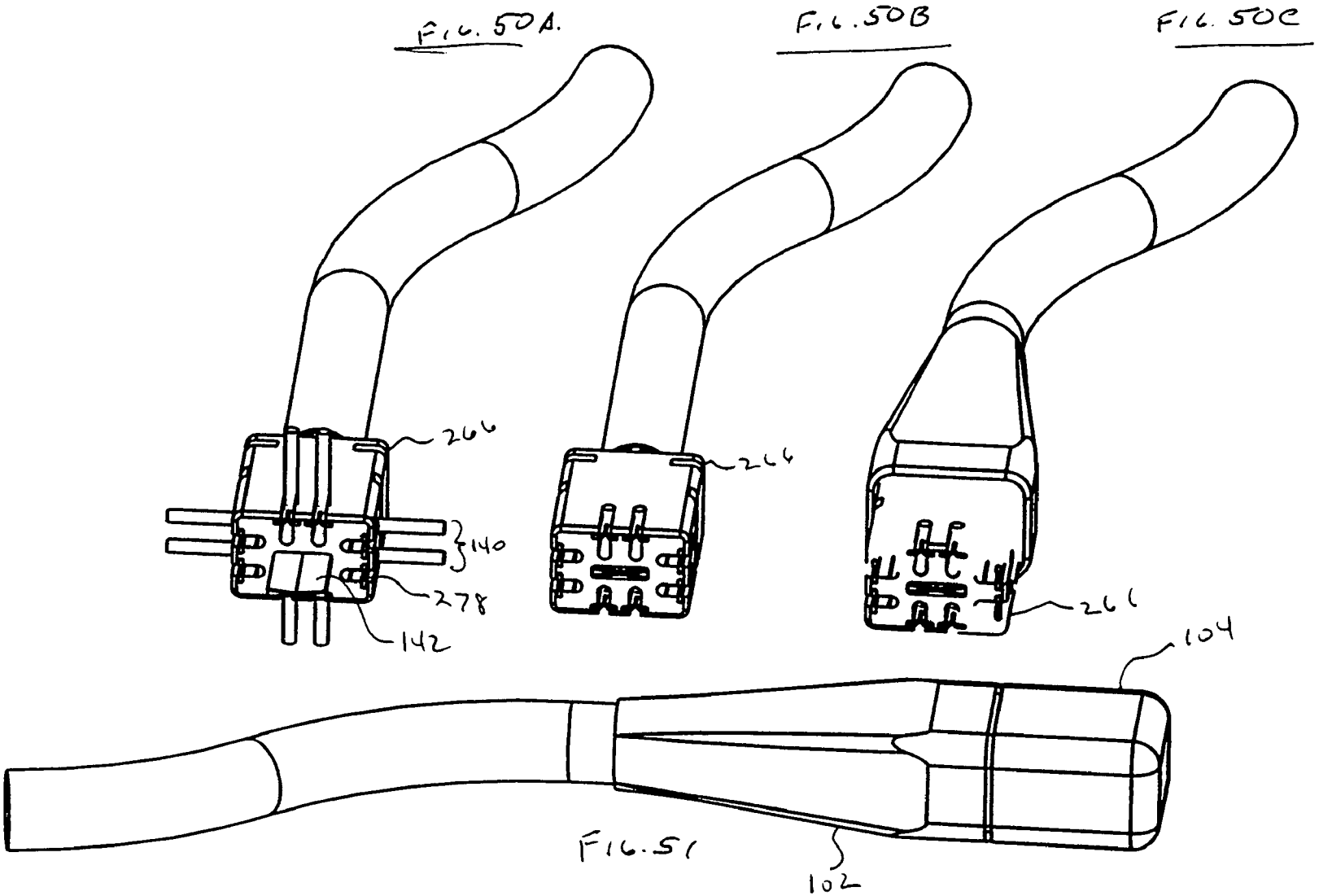
FIGS. 50*a*-50*c* sequentially illustrate trimming of the twisted pair conductors and placement of a strain relief on the connector in accordance with an embodiment of the invention.
FIG. 51 is a perspective view of the connector and a connector cover in accordance with an embodiment of the invention.

FIGS. 50*a*-50*c* depicts the final steps in assembly of the IDC pair separator 266 to the twisted pair cable in making a completed connector 102.

Referring to FIGS. 50*a*-50*c*, FIG. 50*a* depicts the connector in similar status to FIG. 48. FIG. 50*b* depicts connector 102 with excess conductor lengths and plus shape divider trimmed flush with sides and front end 268 of IDC pair separator 266.

FIG. 50*c* depicts the addition of strain relief 116 to IDC pair separator 266. Strain relief 116 may either have been slid onto twisted pair cable prior to beginning assembly or can be insert molded directly onto the cable and IDC pair separator 266.

FIG. 51 depicts connector 102 with strain relief 116 and connector cover 104 installed.

IDC to RJ Adapter

Figures 52, 53, 54:
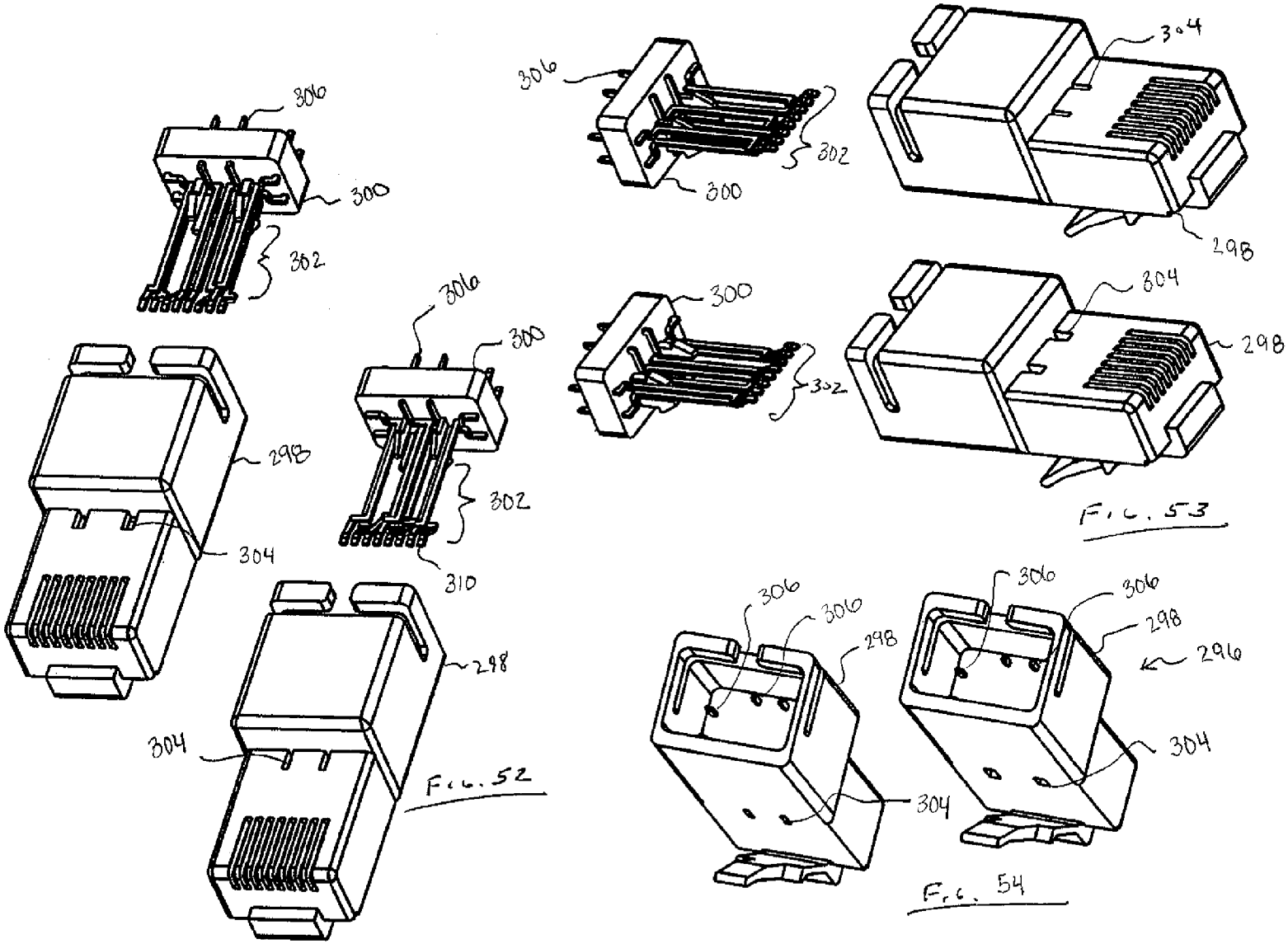
FIG. 52 is an exploded perspective view of two embodiments of the RJ adapter in accordance with the present invention.
FIG. 53 is another exploded perspective view of the two embodiments depicted in FIG. 52.
FIG. 54 is a perspective view of two embodiments of the RJ adapter in accordance with the invention.

FIGS. 52-54 illustrate the assembly IDC to RJ Adapter 296. IDC TO RJ Adapter 296 generally includes adapter housing 298, contact spring retainer 300 and contact springs 302. FIGS. 52 and 53 are exploded views of IDC TO RJ Adapter 296. Adapter housing 298 defines a pair of slots 304 on top of the housing and another pair of slots 304 on the bottom of the housing.

Contact spring retainer 300 holds eight contact springs 302 that make-up IDC to RJ adapter 296 electrical path. Blade portion 306 of contacts springs 302 are pressed through holes in contact spring retainer 300. Blade portions 306 are positioned to mate with insulation displacement contacts 278 of IDC pair separator 266.

Contact spring retainer 300 further includes cantilever snaps 308 protruding therefrom. Cantilever snaps 308 seat into and lock into slots 304 of adapter housing 298. This interlock holds contact spring retainer 300 in place and keeps it from coming out of adapter housing 298.

Each of FIGS. 52, 53 and 54 depict two possible contact spring 302 configurations. In one embodiment, quadrant spacing and isolation between pairs is attempted to maintain the quadrant positioning of twisted pairs in the cable and IDC pair separator 266 through the length of adapter housing 298. In another embodiment, crossovers or partial twist are created within the contact spring 302 conductors of the pairs while still adhering somewhat to a quadrant approach. Variations and combinations of these techniques may be used to optimize signal transmission properties of IDC TO RJ Adapter 296 by canceling or balancing crosstalk between pairs.

Contacts springs 302 also include RJ interface portion 310. RJ interface portions 310 protrude through openings 312 and are exposed to make contact with RJ 45 jack springs when mated.

Referring to FIG. 54, IDC to RJ Adapter 296 is depicted from the rear where IDC pair separator 266 may be inserted to mate with IDC to RJ Adapter 296. Blade portions 306 can be seen positioned for alignment and connection with insulation displacement contacts 278.

Matting IDC Pair Separator with IDC to RJ Adapter

Figures 55, 56, 57, 58, 59:
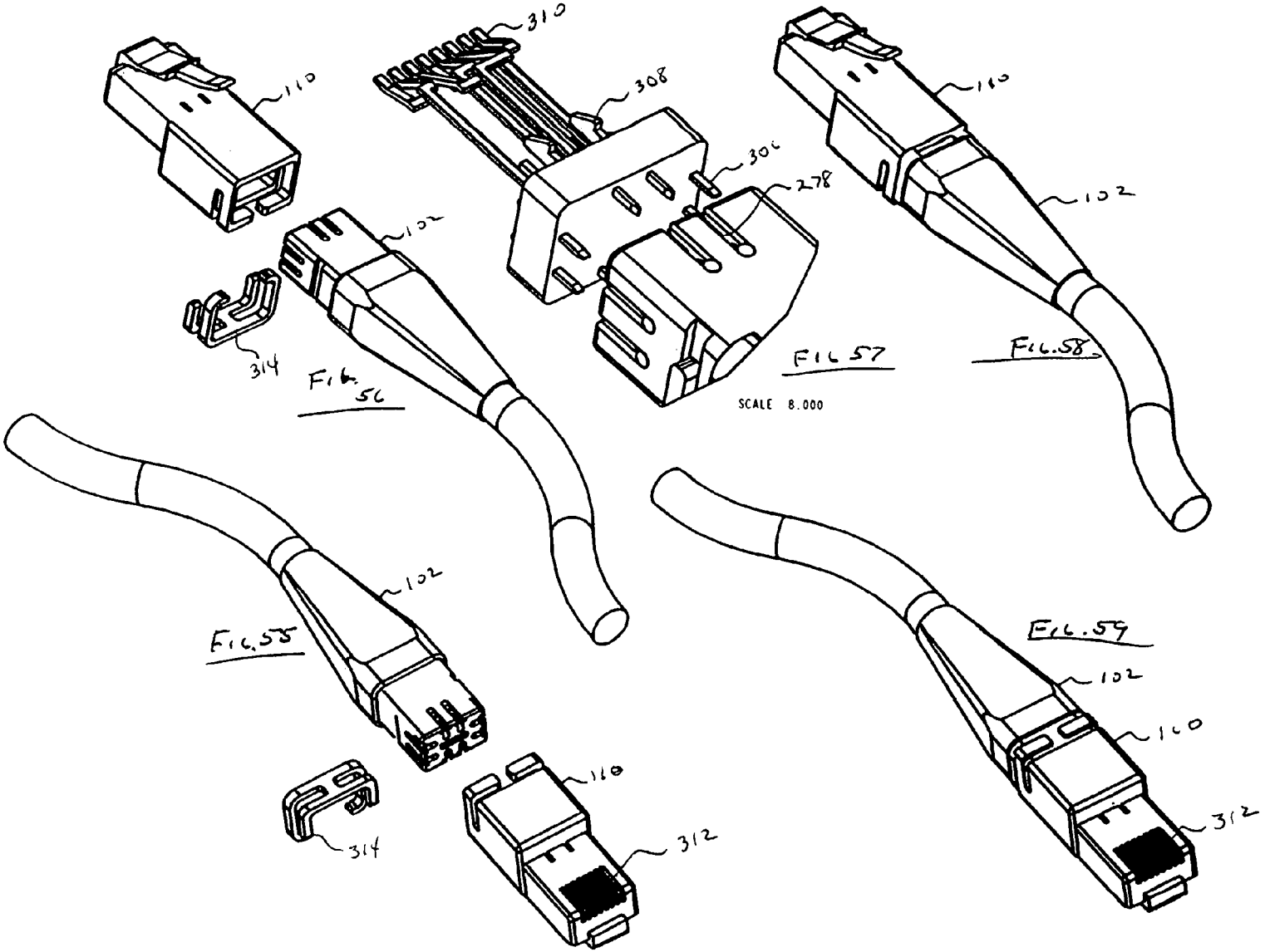
FIGS. 55 and 56 are perspective views of the connector RJ adapter and locking clip in accordance with an embodiment of the invention.
FIG. 57 is a detailed perspective view depicting a coupling relationship between insulation displacement contacts and blade contacts with certain parts removed for clarity.
FIGS. 58 and 59 are perspective views of the assembled connector and RJ adapter in accordance with an embodiment of the invention.

FIGS. 55 and 56 depict connector 102 including IDC pair separator 266. IDC to RJ Adapter 296 and locking clip 314.

FIG. 57 depicts a magnified view of how IDC pair separator 266 mates to blade portions 306 of contacts springs 302. Blade portions 306 are oriented in position to align and fit into connection slots 286.

After IDC to RJ Adapter and IDC pair separator 266 are fully matted, locking clip 314 is securely positioned around IDC pair separator 266 to couple IDC pair separator 266 to IDC to RJ Adapter 296.

FIGS. 60-68 depict IDC connector to RJ jack 316. IDC connector to RJ jack generally includes housing 318 and insert sled 320.

Figures 60, 61, 62, 63:
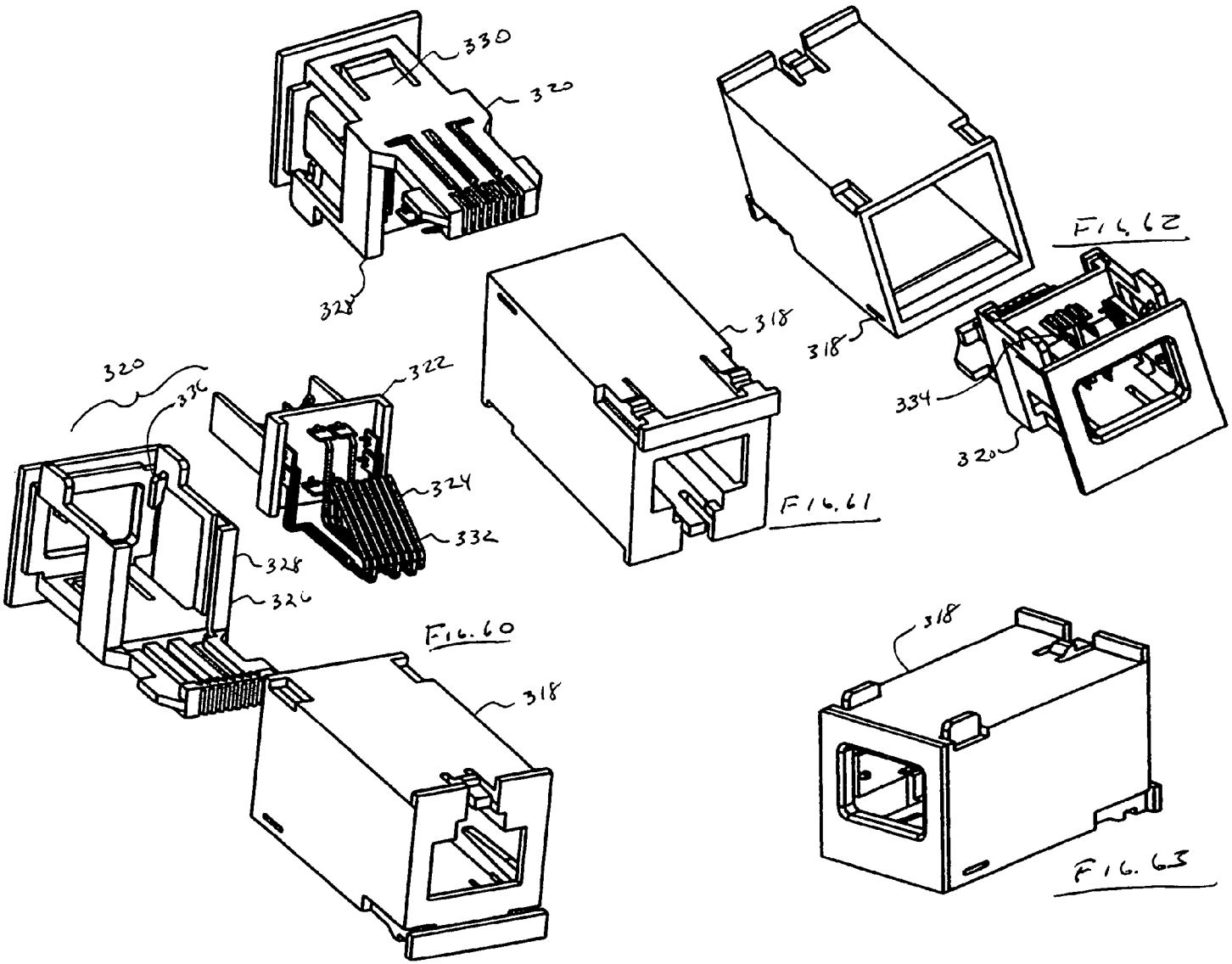
FIG. 60 is a partially exploded perspective view of a connector to RJ jack in accordance with the present invention.
FIGS. 61 and 62 are partially exploded views of the connector to RJ jack in accordance with the present invention.
FIG. 63 is a perspective view of an assembled connector to RJ jack in accordance with the present invention.

Insert sled 320 generally includes spring retainer plate 322, contacts springs 324 and sled body 326. Sled body 326 generally includes guides 328 and latch 330. Spring retainer plate 322 supports contacts springs 324. Spring retainer plate 322 is receivable in the guides 328 to join it with sled body 326. Housing 318 is sized and adapted to receive insert sled 320. FIG. 60 shows housing 318 insert sled 320 and spring retainer plate 322 with contact springs 324 in exploded relationship. FIGS. 61 and 62 depict housing 318 and insert sled 320, depicting their general orientation during assembly. FIG. 63 depicts assembled IDC connector to RJ jack 316. Contact springs 324 include RJ spring portion 332 and blade tip contact ends 334. Blade tip contact ends 334 are adapted to mate with connection slots 286 of insulation displacement contacts 278. This relationship is best seen in FIGS. 67 and 68.

Sled body 326 includes catch features 336. Catch features 336 are positioned to interlock with inset slots 294 of IDC pair separator 266.

Figures 64, 65, 66, 67, 68:
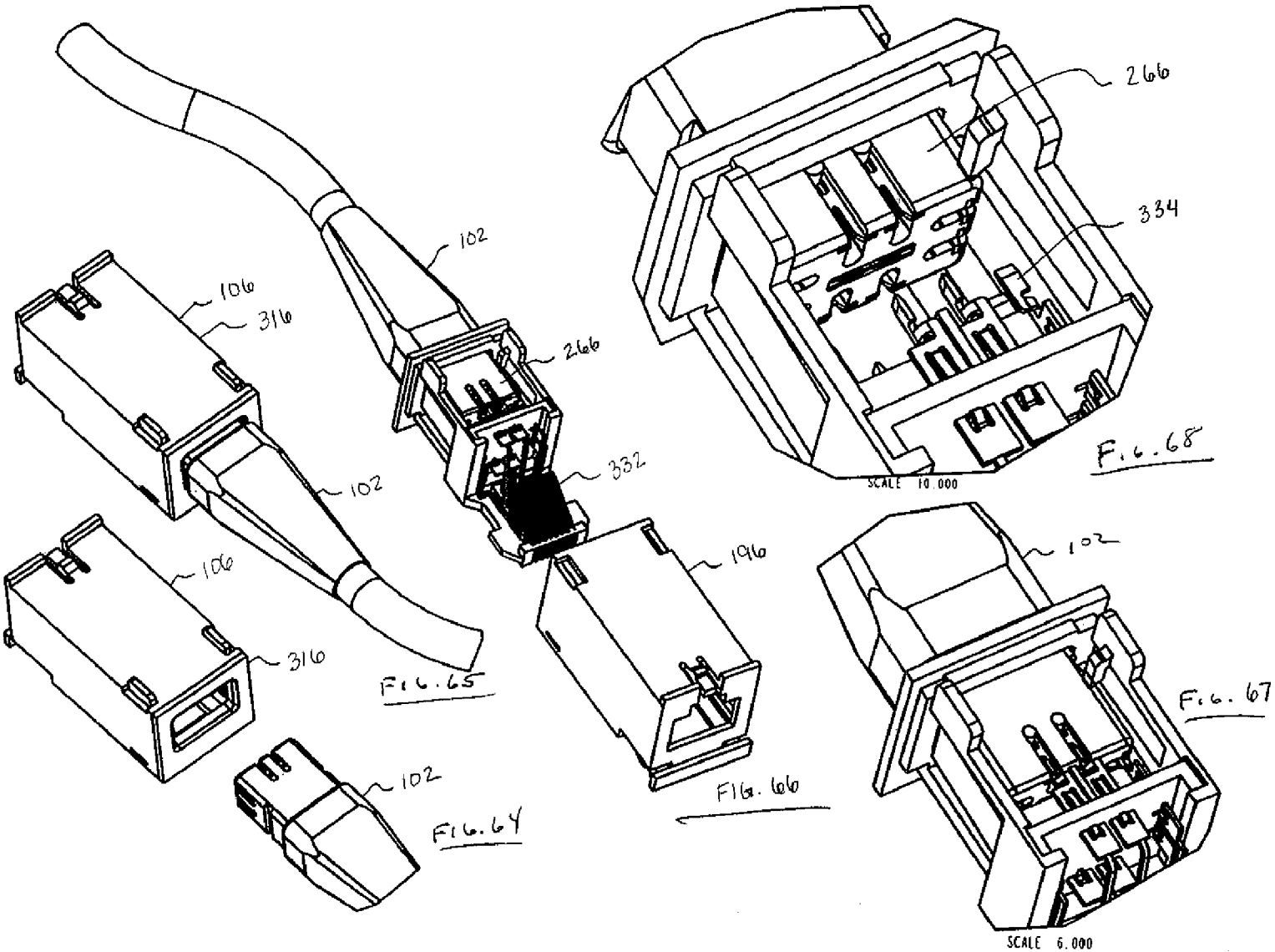
FIG. 64 is a perspective view of the connector and the connector to RJ jack in accordance with the present invention.
FIG. 65 is a perspective view of a connected connector and connector to RJ jack in accordance with the present invention.
FIG. 66 is a perspective view of the coupled connector and RJ to connector jack with the RJ to connector jack partially exploded for clarity.
FIG. 67 is a detailed view showing the coupling of insulation displacement contacts to blade contacts in accordance with an embodiment of the present invention.
FIG. 68 is a detailed view depicting the blade contacts and insulation displacement contacts nearly coupled.

Referring to FIGS. 64 and 65, IDC pair separator 266 is depicted as inserted into IDC connector to RJ jack 316.

FIG. 66 depicts a partially exploded view depicting IDC pair separator 266 as inserted into IDC connector to RJ jack with housing 318 removed.

Referring to FIGS. 69*a*-94 another embodiment of the invention is depicted.

Referring to FIGS. 69*a*-82, in this embodiment connector 102 generally comprises pair separator 338, pair guide 340 and strain relief 116. Strain relief 116 is substantially similar to that which has already been described and will not be described further in this embodiment.

Figures 69A, 69B, 69C, 70, 71, 72, 73:
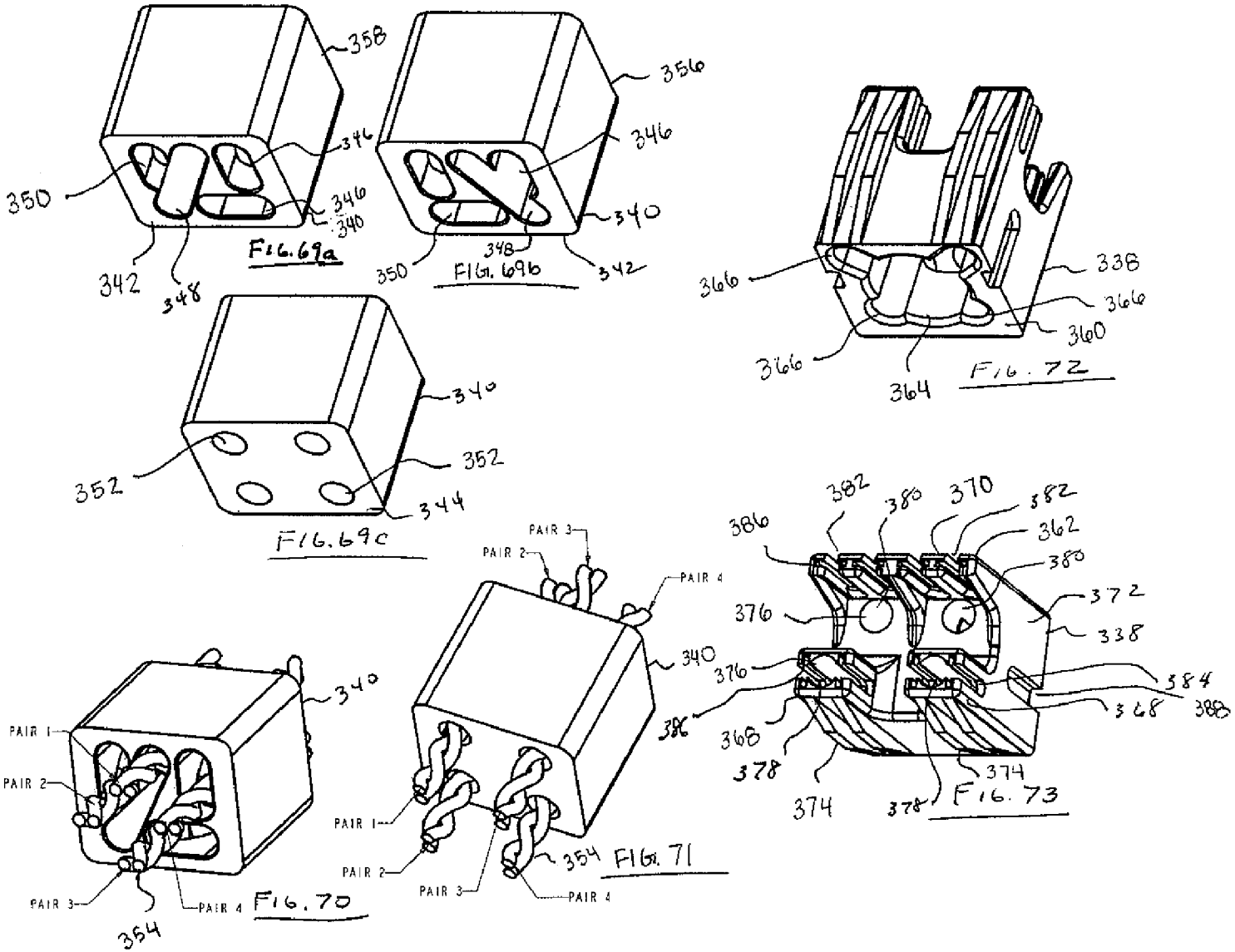
FIGS. 69*a*-69*c* are perspective views of pair guides in accordance with the present invention.
FIG. 70 is a perspective view of a pair guide and twisted pairs as passed through the pair guide in accordance with the present invention.
FIG. 71 is a perspective view depicting the twisted pairs from an opposed side of the pair guide as in FIG. 70.
FIG. 72 is a rear perspective view of a pair separator in accordance with an embodiment of the invention.
FIG. 73 is a front perspective view of the pair separator depicted in FIG. 72.

Referring to FIGS. 69*a*-71, pair guide 340 is typically injection molded of a non-conductive, dielectric material. Pair guide 340, in one aspect of the invention, is generally a rectangular prism having first end 342 and second end 344. Pair guide 340 defines four channels 346 which pass through pair guide 340 from first end 342 to second end 344. One of channels 346 is crossing channel 348. Referring particularly to FIGS. 70 and 71, channels 346 enter first end 342 of pair guide 340 at oval entrances 350 and exit pair guide 340 at round exits 352 located at second end 344. Twisted pairs 354 enter first end 342 of pair guide 340 as depicted in FIG. 70 and exit pair guide 340 as depicted in FIG. 71. Ramped surfaces (not shown) that are design into each channel 346 redirect the pairs into the required quadrant positions as depicted in FIG. 71.

Referring particularly to FIGS. 69*a* and 69*b*, it is noted that pair guide 340, in one aspect of the invention, is made in two versions, first handed pair guide 356 and a second handed pair guide 358. For a twisted pair cable that is terminated on both ends with connector 102 as defined in this embodiment, first handed pair guide 356 may be utilized at a first end of the cable and second handled pair guide 358 is used at the second end of the cable. The difference between first handed pair guide 356 and second handed pair guide 358 is the configuration of crossing channel 348. In both cases crossing channel 348 extends from first end 342 to second end 344, however, in first handed pair guide 356 crossing channel 348 ends in a different quadrant than in second handed pair guide 358. The two pair guides 340 effectively position the pairs into required quadrants to maintain pair placement and position consistency. First handed pair guide 356 and second handed pair guide 358 may be substantially mirror images of each other.

Referring particularly to FIGS. 72 and 73, pair separator 338 generally defines first end 360 and second end 362. First end 360 defines a single entrance 364 having four lobes 366. Second end 362 presents towers 368 and wall 370. Pair separator 338 has four substantially parallel sides 372. Wall 370 is integral with and may extend coplanar to one of sides 372. Towers 368 are located at the corners of a side opposing wall 370. Towers 368 present rails 374 which extend from towers 368 onto one of sides 372.

Referring particularly to FIG. 73, each of lobes 366 transitions within pair separator 338 to create four holes 376. Holes 376 include two tower holes 378 and two wall holes 380. Tower holes 378 emerge centrally from towers 368. Wall holes 380 emerge adjacent wall 370.

Pair separator 338 also defines wall slots 382 and tower slots 384. In some embodiments of the invention, four wall slots pass through wall 370 in substantially parallel orientation. Each of wall holes 380 is substantially adjacent to two wall slots 382.

In the embodiment depicted, tower slots 384 pierce towers 368 on opposing sides thereof. Tower slots 384 are in communication with tower holes 378. In one aspect of the invention, tower slots 384 are aligned on similar opposing sides of towers 368.

Wall slots 382 and towers slots 384 also present contact channels 386. Contact channels 386 straddle wall slots 382 and tower slots 384.

Referring particularly to FIGS. 72 and 73, pair separator 338 presents latching channels 388 on opposing sides thereof. Latching channels 388 serve to receive latching features to retain connector 102.

Assembly of the Connector

Figures 74, 75, 76:
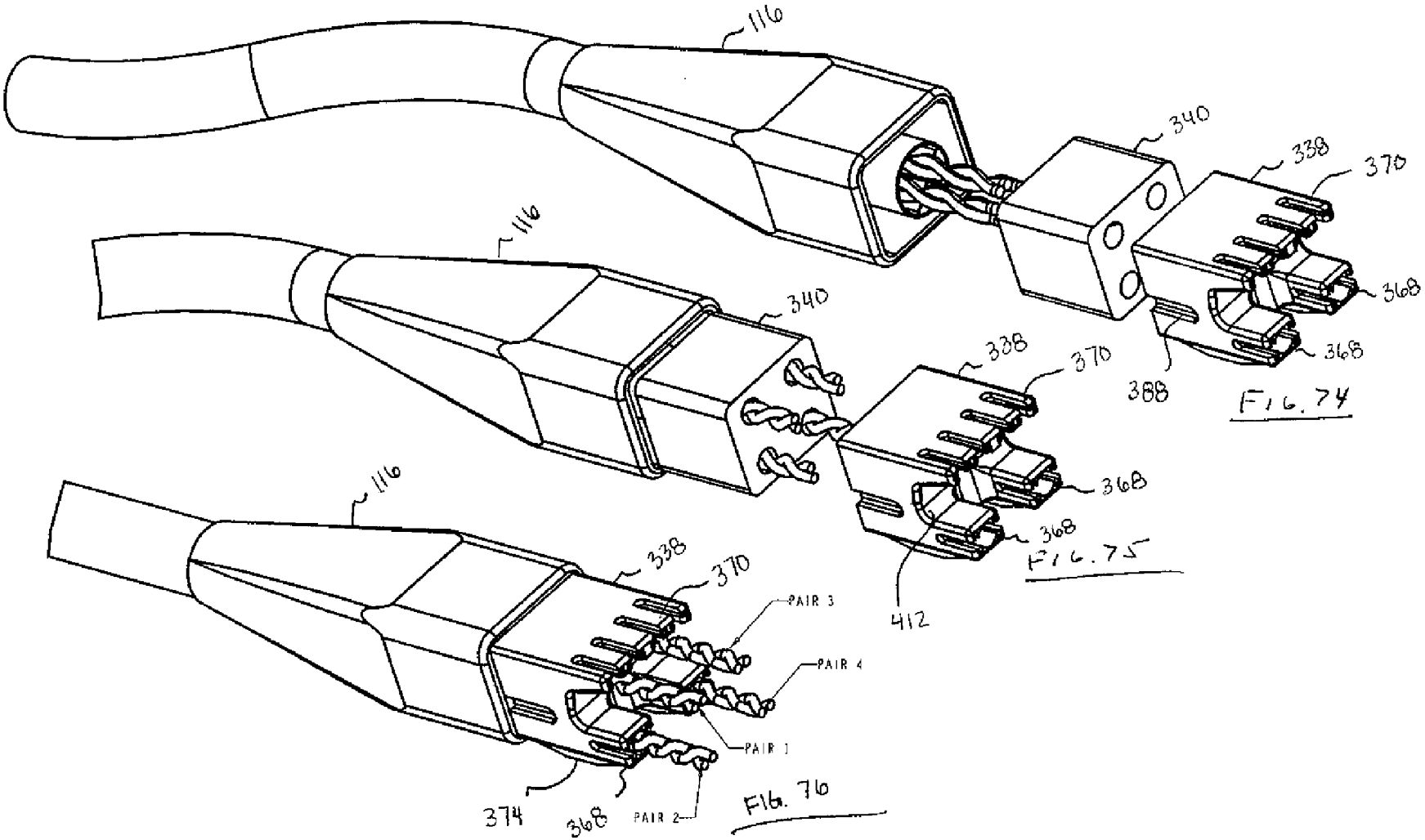
FIG. 74 is a perspective view of a twisted pair cable, strain relief, pair guide and pair separator in accordance with this embodiment of the invention.
FIG. 75 is a perspective view of the twisted pair cable, pair guide and pair separator partially assembled.
FIG. 76 is a perspective view showing the further sequence of assembly and termination of the connector.

Referring to FIGS. 74-80, a sequence of assembling connector 102 to twisted pair cable is depicted. Referring to FIG. 74, strain relief 116 may be slid onto a twisted pair cable as a separate piece. Strain relief 116 may also be insert molded around the otherwise completed assembled connector 102. Outer jacket 390 of twisted pair of cable is stripped back and center plus shaped divider is trimmed back approximately flush with the end of outer jacket 390. Care should be taken not to disrupt the twist and lay of the connector pairs for a specified distance from the end of the cut outer cable jacket 390. Referring to FIG. 75, twisted pairs 140 are then pushed into first end 342 of pair guides 340 such that twisted pairs 140 protrude outwardly from round exits 352.

Referring to FIGS. 75 and 76, pair separator 338 is then placed over exposed twisted pairs 140. Pair separator 338 and pair guide 340 slide up against one another and back into strain relief 116 if present.

Orientation of twisted pairs 140 is such that pair two will reside as shown in left tower 368, pair four will reside in right tower 368, pair one will protrude out of the left wall holes 380 and pair three will protrude from right wall hole 380 as depicted. It is noted that these positions will vary depending upon whether first handed pair guide 356 or second handled pair guide 358 is used.

Figures 77, 78, 78A, 79, 79A, 80, 81, 82:
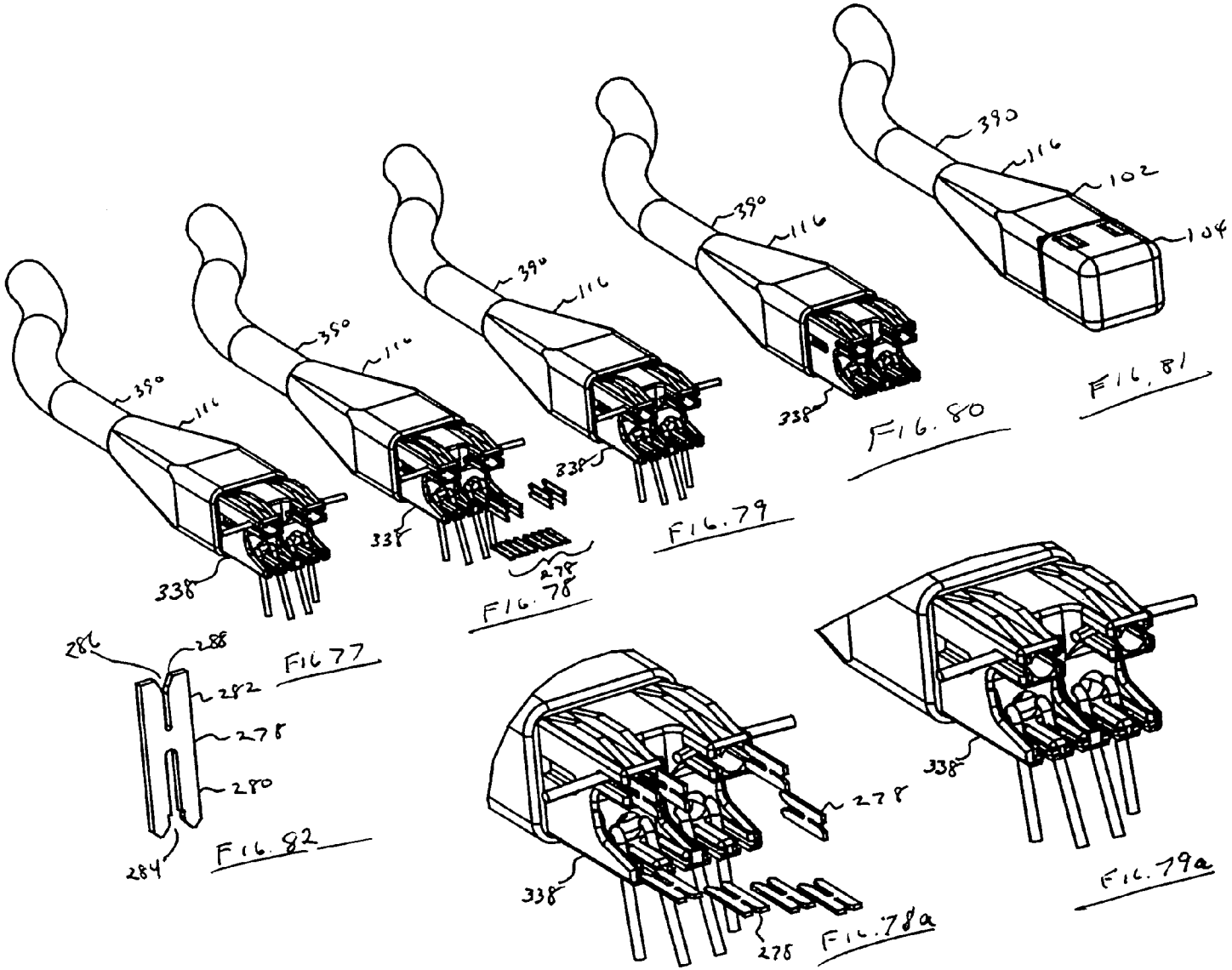
FIG. 77 is a perspective view of the partially assembled connector.
FIGS. 78 and 78*a* are perspective views of the partially assembled connector including uninserted insulation displacement contacts.
FIGS. 79 and 79*a* are perspective views of the partially assembled connector with the insulation displacement contacts inserted into the pair separator.
FIG. 80 is a perspective view of the assembled connector with the twisted pair conductors trimmed off.
FIG. 81 is a perspective view of the assembled connector with a connector cover in place.
FIG. 82 is a perspective view of an insulation displacement contact in accordance with an embodiment of the present invention.

Referring now FIG. 77, each twisted pair 140 is untwisted only as far as necessary to place the correct conductor of each twisted pair 140 into the bottom of the appropriate wall slot 382 or tower slot 384. The twisted pair conductors are then pulled through wall slot 382 or tower slots 384 and bent outwardly from pair separator 338 at an angle of approximately 90°.

Referring now to FIGS. 78 and 78*a*, insulation displacement contacts 278 as described above are inserted into wall slots 382 and towers slots 384. As has been described above, insulation displacement contacts 278 pierce the insulation and make electrically contact with the copper conductive core of each conductor. Insulation displacement contacts 278 are sized in their exterior dimensions to be approximately equivalent to wall slots 382 and tower slots 384.

FIGS. 79 and 79*a* depict connector 102 with insulation displacement contacts 278 fully inserted.

Referring to FIG. 80, the free ends of conductors of the twisted pairs are then sheared off approximately flushed with pair separator 338.

Referring to FIG. 81, protective connector cover 104 may then be placed over pair separator 338.

Referring to FIGS. 83-90, in this embodiment of the invention, RJ adapter 110 generally includes housing 392 and insert 394. Housing 392 is generally similar to other RJ adapter housings described above.

Insert 394 generally includes interface contacts 396, printed circuit board 398 and insert housing 400. Interface contacts 396 generally include RJ contacts 402, top side contacts 404 and bottom side contacts 406. RJ contacts 402, in one aspect of the invention, are coupled to printed circuit board 398 and arranged for use in a male RJ style connector, which is well known in the art. Top side contacts 404 are adapted to fit into plated through holes in printed circuit board 398 and to coupled to insulation displacement contacts 278 located in towers 368. Bottom side contacts 406 are adapted to press into printed circuit board 398 through holes from bottom side of printed circuit board 398 and to couple with insulation displacement contacts 278 of wall 370.

Figures 83, 84, 85, 86, 87:
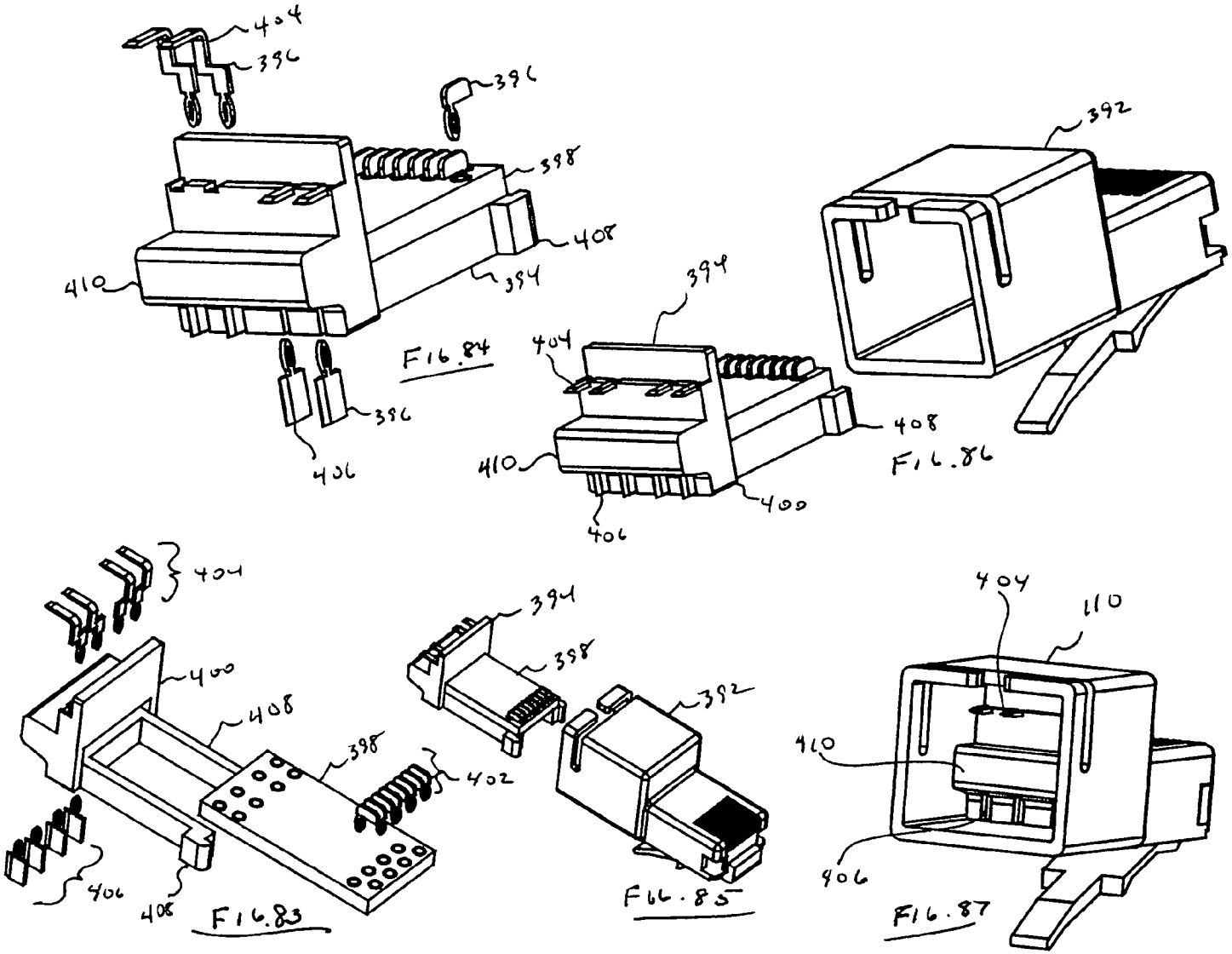
FIG. 83 is an exploded view of an insert housing including a printed circuit board for use in a RJ adapter in accordance with an embodiment of the present invention.
FIG. 84 is a partially exploded perspective view of the insert housing.
FIG. 85 is a partially exploded perspective view of a RJ adapter in accordance with an embodiment of the present invention.
FIG. 86 is a partially exploded perspective view of an insert housing in accordance with an embodiment of the present invention.
FIG. 87 is a perspective view of the RJ adapter in accordance with this embodiment of the invention.

Insert housing 400 presents cantilever latches 408. FIGS. 85-87 depict the assembly of insert housing 400 into housing 392 of RJ adapter 110 in this embodiment.

Figures 88, 89, 90:
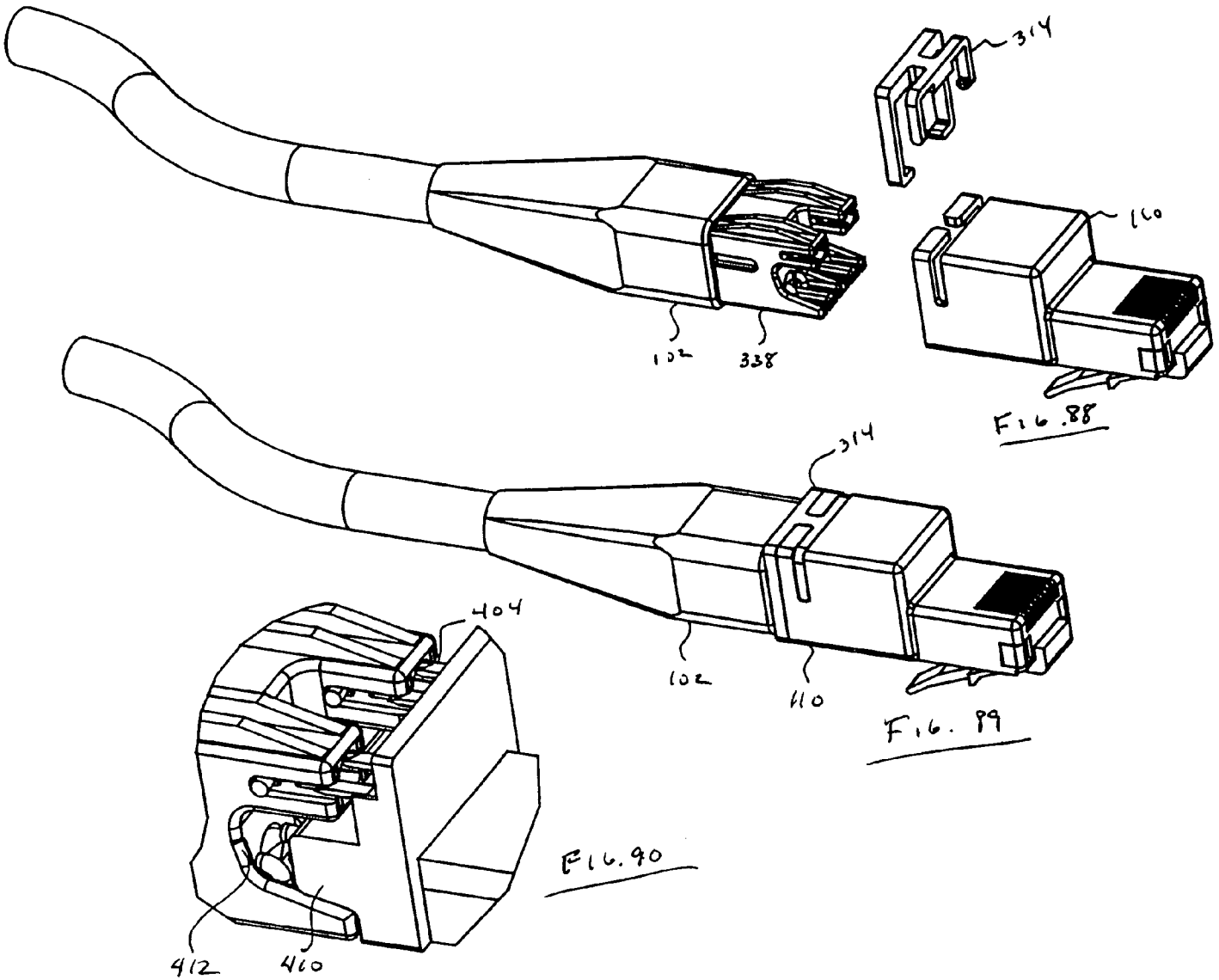
FIG. 88 is a perspective view of a connector RJ adapter and locking clip in accordance with this embodiment of the invention.
FIG. 89 is an assembled perspective view of the RJ adapter and connector.
FIG. 90 is a detailed perspective view of the relationship between insulation displacement contacts and interface contacts in accordance with the present invention.

FIGS. 88-90 depict the mating of RJ adapter 110 to connector 102 in this embodiment. Referring to FIG. 88, connector 102 is aligned with RJ adapter 110, and as depicted in FIG. 89 inserted into RJ adapter 110. Locking clip 314 is then used to secure RJ adapter 110 to connector 110.

FIG. 90 depicts the interaction of keying ledge 410 with keying recess 412. This feature of the invention prevents connector 102 from being inserted into RJ adapter 110 in an improper orientation.

Referring to FIGS. 91-94, another embodiment of connector to RJ jack 106 is depicted. In this embodiment connector to RJ jack 106, generally includes housing 416 and insert 418. Housing 416 is generally similar to those described above. Insert 418 defines port window 420. Port window 420 includes alignment lobes 422. Alignment lobes 422 are located and sized to receive rails 374 to assure proper orientation of connector 102 when it is inserted through port window 420. Insert 418 also includes cantilever latch arm 172, guides 176, release latch mechanisms 186, tabs 188, wedge legs 190, cantilever wall structures 194 and catch bumps 196, similar to those described above. Insert 418 further includes printed circuit board 424 supporting RJ spring contacts 426 and contact assembly 428.

Contact assembly 428 supports top side contacts 404, bottom side contacts 406 and presents keying ledge 410 similar to that described above with relation to RJ adapter 110 of this embodiment. These structures are generally similar to and operate similarly to those described above with relation to RJ adapter 100 and in accordance with this embodiment of the invention.

Figures 91, 92, 93, 94:
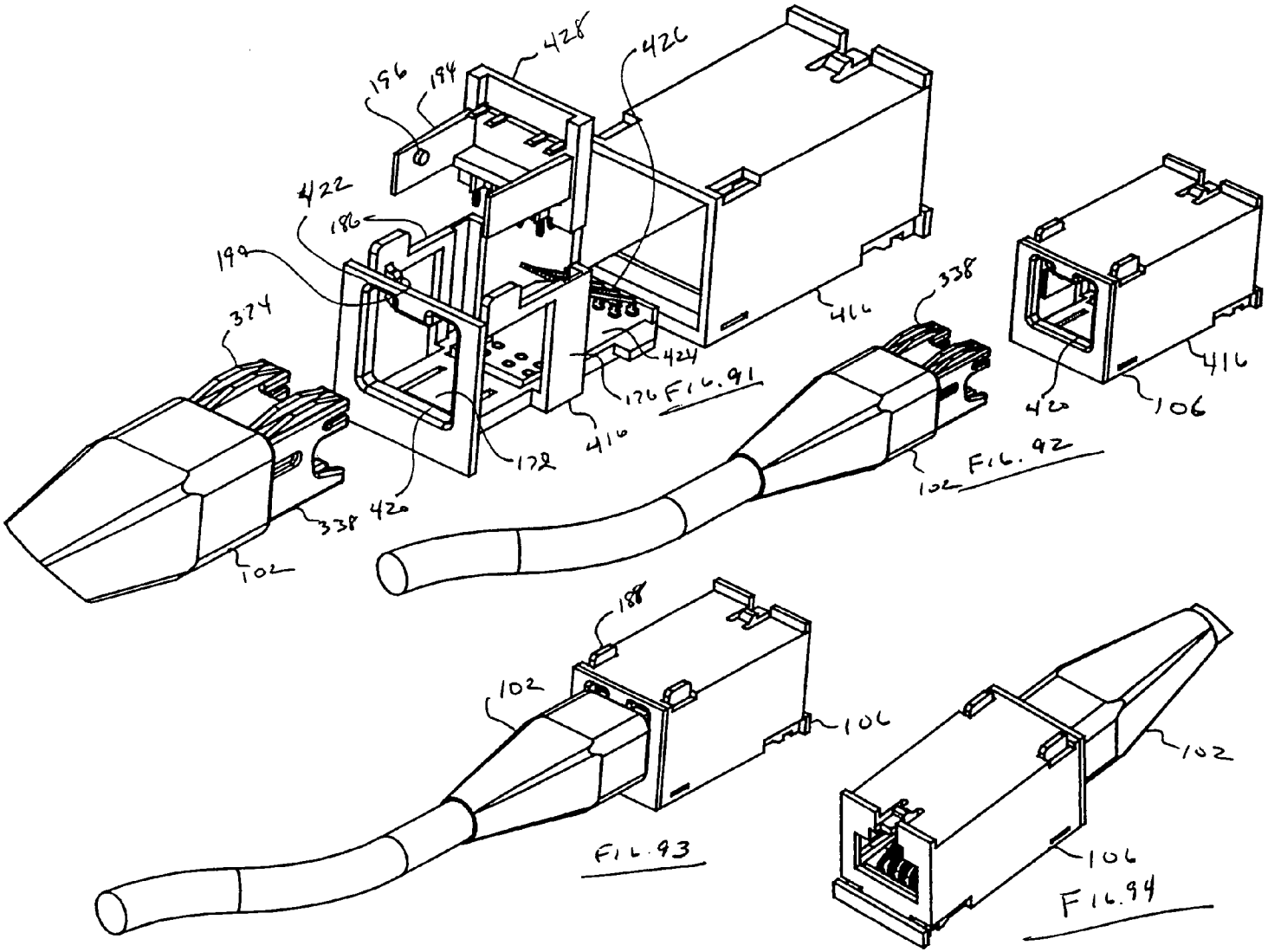
FIG. 91 is an exploded perspective view of a connector and connector to RJ adapter in accordance with the present invention.
FIG. 92 is a perspective view of a connector and connector to RJ adapter in accordance with the present invention.
FIGS. 93 and 94 are perspective views of the coupled connector and connector to RJ jack in accordance with the present invention.

FIG. 91 depicts a partially exploded view of connector to RJ jack 106 in accordance with this embodiment of the invention.

FIGS. 92-94 depict the insertion of connector 102 into connector to RJ jack 106 and in accordance with this embodiment of the invention.

FIGS. 95-98 depict connector to connector Jack 108 in accordance with an embodiment of the invention. In this embodiment, connector to connector Jack 108 includes two contact assemblies 428 substantially similar to those described above in connector to RJ jack connector 106 in accordance with this embodiment of the invention. Connector to connector jack 108 in this embodiment also includes guides 176, release latch mechanism 186, tabs 188, wedge legs 190, cantilever wall structures 194 and catch bumps 196 similar to those described above. Contact assemblies 428 are aligned substantially back to back and interconnected mechanically and electrically by printed circuit board 430. Printed circuit board 430 may be conventional printed circuit board or flexible printed circuit 222 similar to that described above. In addition, stamped and formed continuous spring members may also be used to electrically interconnect two connectors 102 that are inserted into connector to connect jack 108.

Figures 95, 96, 97, 98:
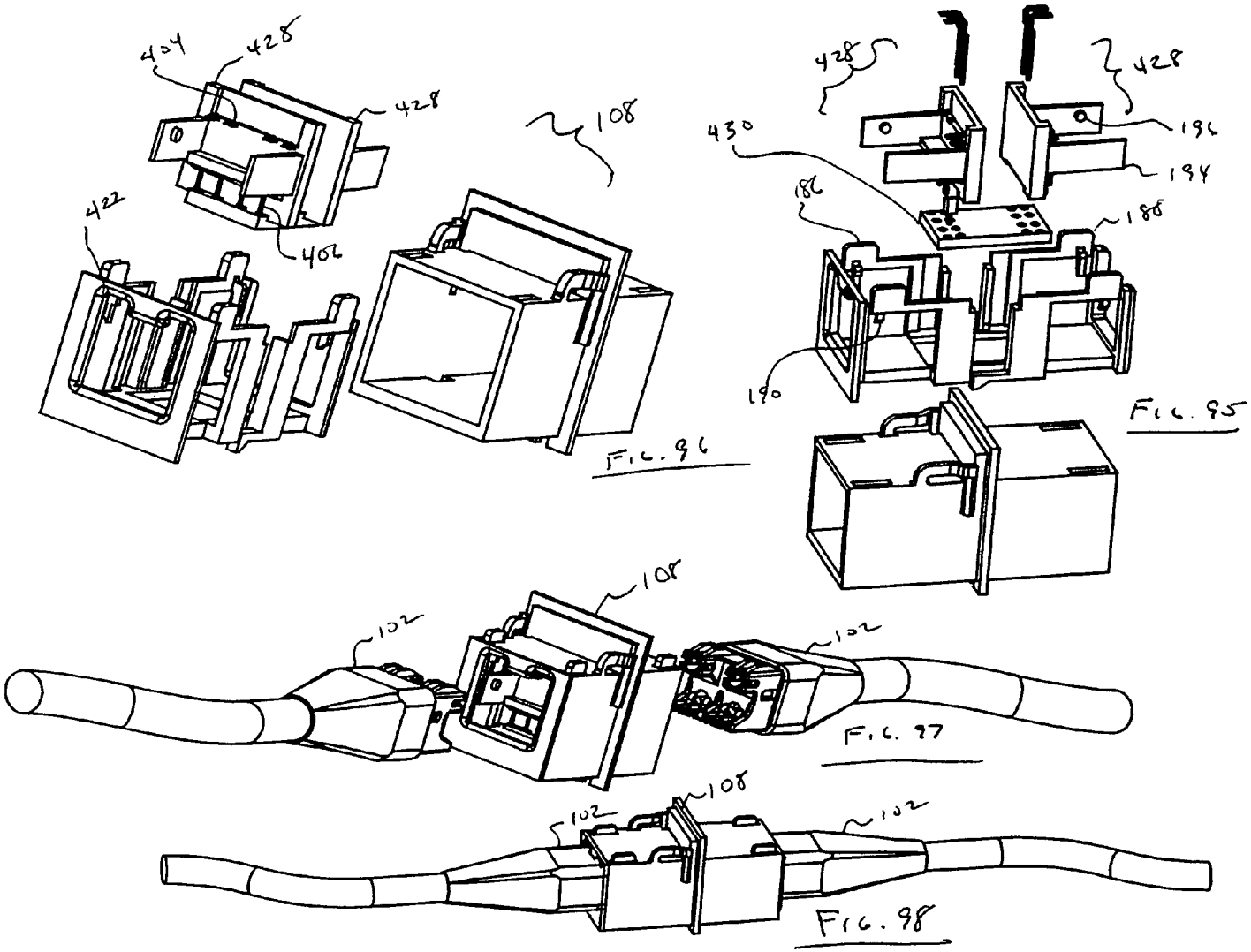
FIG. 95 is an exploded perspective view of a connector to connector jack in accordance with this embodiment of the present invention.
FIG. 96 is a partially exploded perspective view of the connector to connector jack in accordance with this embodiment of the present invention.
FIG. 97 is a perspective view depicting two connectors and the connector to connector jack in accordance with the present invention.
FIG. 98 is a perspective view of the coupled connectors and connector to connector jack in accordance with this embodiment of the present invention.

FIG. 95 shows an exploded perspective view of connector to connector jack 108 in accordance with this embodiment. FIG. 96 depicts a partially exploded view.

FIGS. 97 and 98 depict the connection of two connectors 102 with connector to connector jack 108 in accordance with this embodiment of the invention.

Figures 98, 100, 101:
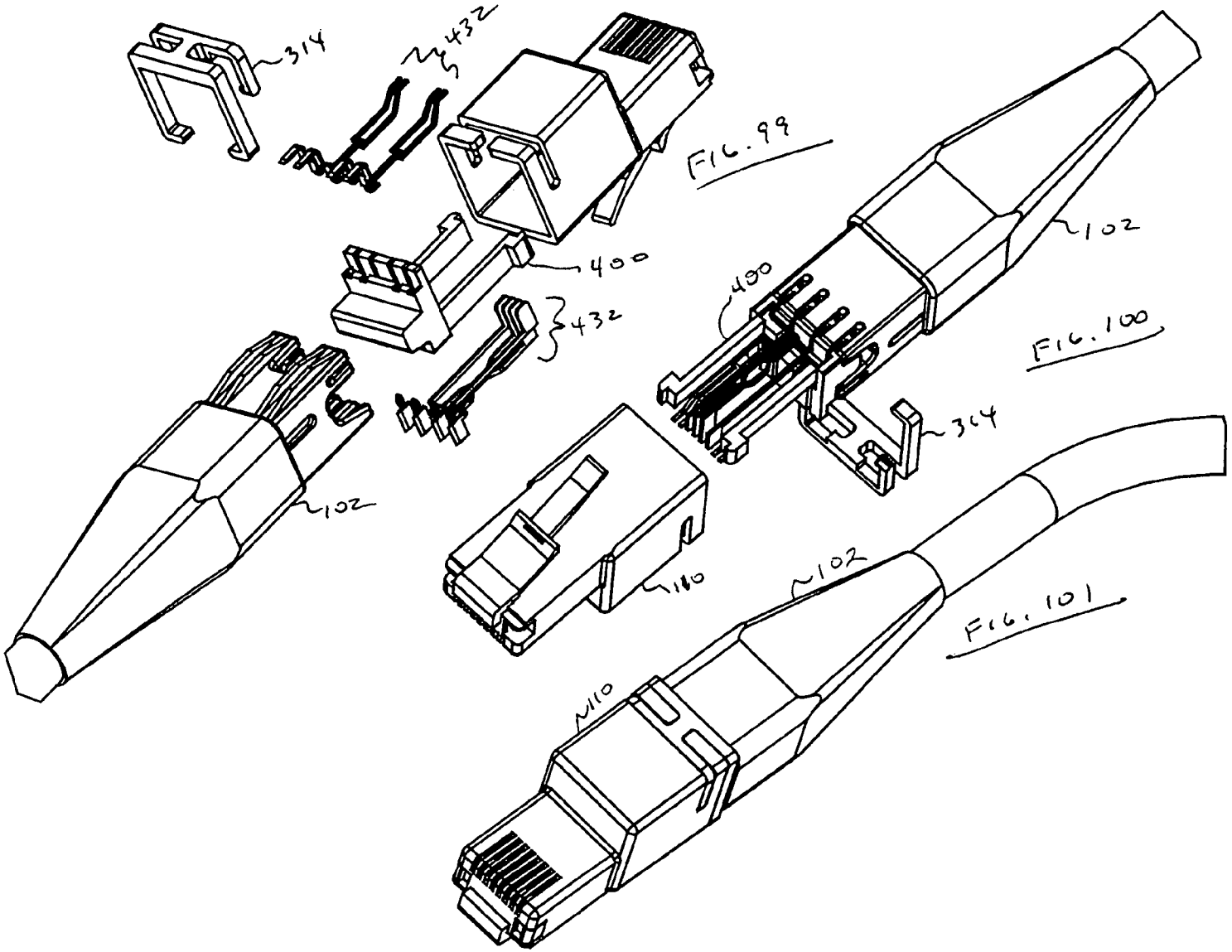
FIG. 100 is a perspective view of a connector and RJ adapter as coupled with the RJ adapter depicted exploded for clarity.
FIG. 101 is a perspective view of a coupled connector and RJ adapter and locking clip in accordance with the present invention.

FIGS. 99-101 depict an embodiment of RJ adapter 110 similar to that depicted in FIGS. 84-87 including stamped and formed spring contacts 432 in place of printed circuit board 398 and interface contacts 396. RJ adapter 110, as depicted here, utilizes continuous stamped and formed spring members in place of printed circuit board 398 to achieve continuity and cross talk performance management. In both the printed circuit board 398 situation and the spring member 414 embodiment, cross talk management techniques may be used to tune cross talk performance, such that it meets the de-embedded cross talk limits defined in ANSI/TIA/EIA 568-B-2.11. These limits are defined to assure interoperability between vendors and components that are used in structured wiring systems.

The present invention may be embodied in other specific forms without departing from the spirit of the essential attributes thereof; therefore, the illustrated embodiments should be considered in all respects as illustrative and not restrictive, reference being made to the appended claims rather than to the foregoing description to indicate the scope of the invention.

What is claimed is:

1. A component for coupling twisted pair network cables that comprise a plurality of twisted pairs for connecting telephone or computer network equipment, the component comprising:

a first set of electrical contacts including a first plurality of the contact members arranged in a first geometric orientation within a housing directed in a first direction, the housing presenting a first generally rectangular aperture and structured to make electrical contact with contacts of a first male repeatably couplable and decouplable electrical connector that is generally rectangular in cross sectional shape to be received in a close mating relationship into the first generally rectangular aperture;

a second set of electrical contacts including a second plurality of contact members arranged in a second geometric orientation within the housing directed in a second direction different from the first direction, the housing presenting a second generally rectangular aperture and structured to make electrical contact with contacts of a second male repeatably couplable and decouplable electrical connector that is generally rectangular in cross sectional shape to be received in a close mating relationship into the second generally rectangular aperture; and a printed circuit operably electrically connecting at least some of the first plurality of contact members to respective members of the second plurality of contact members, the printed circuit acting to balance crosstalk between the plurality of twisted pairs;

wherein at least one of the first set of electrical contacts or the second set of electrical contacts is arranged such that four of the contact members are arrayed generally in a first rectilinear row and four of the contact members are arrayed in a second row generally parallel to and perpendicularly displaced from the first row and in two groups of two contacts each, the two contacts in each group being separated by a first small spacing and the two groups being spaced apart from each other by a second spacing larger than the first small spacing.

2. The component as claimed in claim 1, further comprising a housing into which the first couplable electrical connector and the second couplable electrical connector are received.

3. The component as claimed in claim 1, wherein the first geometric orientation and the second geometric orientation are similar to one another.

4. The component as claimed in claim 1, wherein the first geometric orientation and the second geometric orientation are different from one another.

5. The component as claimed in claim 1, wherein the printed circuit comprises a rigid printed circuit board.

6. The component as claimed in claim 1, wherein the printed circuit comprises a flexible printed circuit.

7. A component for coupling twisted pair network cables that comprise a plurality of twisted pairs for connecting telephone or computer network equipment, the component comprising:

a first set of electrical contacts including a first plurality of the contact members arranged in a first geometric orientation within a housing directed in a first direction, the housing presenting a first generally rectangular aperture and structured to make electrical contact with a first male repeatably couplable and decouplable electrical connector that is generally rectangular in cross sectional shape to be received in a close mating relationship into the first generally rectangular aperture;

a second set of electrical contacts including a second plurality of contact members arranged in a second geometric orientation within the housing directed in a second direction different from the first direction, the housing presenting a second generally rectangular aperture and structured to make electrical contact with a second male repeatably couplable and decouplable electrical connector that is generally rectangular in cross sectional shape to be received in a close mating relationship into the second generally rectangular aperture; and means for operably electrically connecting at least some of the first plurality of contact members to respective members of the second plurality of contact members, the means for operably electrically connecting acting to balance crosstalk between the plurality of twisted pairs;

wherein at least one of the first set of electrical contacts or the second set of electrical contacts is arranged such that four of the contact members are arrayed generally in a first rectilinear row and four of the contact members are arrayed in a second row generally parallel to and perpendicularly displaced from the first row and in two groups of two contacts each, the two contacts in each group being separated by a first small spacing and the two groups being spaced apart from each other by a second spacing larger than the first small spacing.

8. The component as claimed in claim 7, further comprising a housing into which the first couplable electrical connector and the second couplable electrical connector are received.

9. The component as claimed in claim 7, wherein the first geometric orientation and the second geometric orientation are similar to one another.

10. The component as claimed in claim 7, wherein the first geometric orientation and the second geometric orientation are different from one another.

11. The component as claimed in claim 7, wherein the means for operably electrically coupling comprises a rigid printed circuit board.

12. The component as claimed in claim 7, wherein the means for operably electrically coupling comprises a flexible printed circuit.

13. A method of providing materials to facilitate coupling twisted pair network cables that comprise a plurality of twisted pairs for connecting telephone or computer network equipment, the method comprising:

providing a component including:

a first set of electrical contacts including a first plurality of contact members arranged in a first geometric orientation within a housing directed in a first direction, the housing presenting a first generally rectangular aperture and structured to make electrical contact with a first male repeatably couplable and decouplable electrical connector that is generally rectangular in cross sectional shape to be received in a close mating relationship into the first generally rectangular aperture;

a second set of electrical contacts including a second plurality of contact members arranged in a second geometric orientation within the housing directed in a second direction different from the first direction, the housing presenting a second generally rectangular aperture and structured to make electrical contact with a second male repeatably couplable and decouplable electrical connector that is generally rectangular in cross sectional shape to be received in a close mating relationship into the second generally rectangular aperture;

a printed circuit operably electrically connecting at least some of the first plurality of contact members to respective members of the second plurality of contact members, the printed circuit acting to balance crosstalk between the plurality of twisted pairs;

wherein at least one of the first set of electrical contacts or the second set of electrical contacts is arranged such that four of the contact members are arrayed generally in a first rectilinear row and four of the contact members are arrayed in a second row generally parallel to and perpendicularly displaced from the first row and in two groups of two contacts each, the two contacts in each group being separated by a first small spacing and the two groups being spaced apart from each other by a second spacing larger than the first small spacing and providing instructions to:

couple the first couplable electrical connector to the first plurality of the contact members arranged in the first geometric orientation; and couple the second couplable electrical connector to the second plurality of the contact members arranged in the second geometric orientation.

14. The method as claimed in claim 13, further comprising providing the component such that it further comprises a housing into which the first couplable electrical connector and the second couplable electrical connector are received.

15. The method as claimed in claim 13, further comprising providing the component wherein the first geometric orientation and the second geometric orientation are similar to one another.

16. The component as claimed in claim 13, further comprising providing the component wherein the first geometric orientation and the second geometric orientation are different from one another.

17. The component as claimed in claim 13, further comprising providing the component wherein the printed circuit comprises a rigid printed circuit board.

18. The component as claimed in claim 13, further comprising providing the component wherein the printed circuit comprises a flexible printed circuit.

* * * * *